US007357140B2

(12) United States Patent
Chu et al.

(10) Patent No.: US 7,357,140 B2
(45) Date of Patent: Apr. 15, 2008

(54) COLLAPSIBLE STRUCTURE

(75) Inventors: Wan-Sing Chu, Hong Kong (CN); Lai-Ha Wu, Hong Kong (CN)

(73) Assignee: Best Tide Manufacturing Co., Ltd., Hong Kong (CN)

( * ) Notice: Subject to any disclaimer, the term of this patent is extended or adjusted under 35 U.S.C. 154(b) by 463 days.

(21) Appl. No.: 10/812,848

(22) Filed: Mar. 30, 2004

(65) Prior Publication Data

US 2005/0217713 A1 Oct. 6, 2005

(51) Int. Cl.
*E04H 15/44* (2006.01)
*E04H 15/36* (2006.01)
*E04H 15/48* (2006.01)

(52) U.S. Cl. ..... 135/128; 135/124; 135/143; 135/144

(58) Field of Classification Search ..... 135/114, 135/124, 128, 143–144, 146–149, 151, 158; 52/641

See application file for complete search history.

(56) References Cited

U.S. PATENT DOCUMENTS 574,235 A * 12/1896 Bennitt ..... 135/88.04
2,197,478 A * 4/1940 Mathieu ..... 135/147
3,266,503 A 8/1966 Hoiness et al.
4,066,089 A 1/1978 Rainwater
4,815,784 A 3/1989 Zheng
5,411,046 A 5/1995 Wan
5,553,908 A 9/1996 Shink
5,806,549 A * 9/1998 Love ..... 135/143
6,089,247 A 7/2000 Price
6,173,726 B1 1/2001 Talmadge
6,374,843 B1 4/2002 Zou
6,550,491 B1 4/2003 Bixler et al.
7,216,658 B1 * 5/2007 Navarro ..... 135/143
2002/0189659 A1 12/2002 Carter

FOREIGN PATENT DOCUMENTS

EP 0 222 437 10/1990
GB 2 183 267 6/1987

* cited by examiner

*Primary Examiner*—David Dunn
*Assistant Examiner*—Danielle Jackson
(74) *Attorney, Agent, or Firm*—Ladas and Parry LLP

(57) ABSTRACT

A collapsible structure comprises a first frame member including first and second segments hingedly interconnected with each other allowing the collapsible structure to have a collapsed position and an expanded position. The collapsible structure further comprises a second frame member hingedly connected to the first frame member. The second frame member includes first and second segments hingedly interconnected with each other. A hinge member is employed to hingedly connect the first segment and the second segment. At least one of the first and second frame members includes a closed-loop configuration.

12 Claims, 27 Drawing Sheets

COLLAPSIBLE STRUCTURE

FIELD OF THE INVENTION

The present invention relates to a collapsible structure and, in particular, to a collapsible structure having hinge mechanisms.

BACKGROUND OF THE INVENTION

Collapsible structures are known in prior art. Such collapsible structures can be used as tents, pavilions, automobile sun shields, beach mats, shelters, and children playhouses.

U.S. Pat. No. 5,411,046 discloses a collapsible tent having four triangular walls each consisting of foldable material having respective peripheral triangular shaped channel which constrains a coilable wire frame segment. To collapse the tent the walls are folded together into a triangular shaped stack and then the wire frame segments are twisted and folded into overlapping loops. One disadvantage of this type of collapsible structure is that it is difficult to twist and fold the structure into a collapsed configuration. A user has to use both hands and even a foot or a knee to twist and fold the tent. Furthermore, tremendous force is required to twist the coilable wire frame segment of the collapsible structure into overlapping loops.

U.S. Pat. No. 4,815,784 discloses a collapsible automobile sun shield in which two panels are joined end to end to spread out across a car window in an expanded configuration. The panels are adapted to be overlapped and coiled up together. U.S. Pat. No. 5,553,908 discloses a collapsible automobile sun shield comprising a frame segment which is constructed as a single closed loop that can be twisted into a plurality of concentric loops. One typical disadvantage of these collapsible structures is that holding means such as a bag is needed to hold and retain the coiled up and collapsed structure in its collapsed configuration.

SUMMARY OF THE INVENTION

It is an object of the present invention to provide an improved collapsible structure utilizing hinge mechanism.

According to one aspect of the present invention there is provided a collapsible structure comprising a first frame member including first and second segments hingedly interconnected with each other allowing the collapsible structure to have a collapsed position and an expanded position. The collapsible structure further comprises a fabric material associated with the frame member covering at least a portion of the frame member.

In according with an embodiment of the present invention there is provided a collapsible structure wherein the first segment superposes over the second segment when the collapsible structure is in the collapsed position, and wherein the first segment and the second segment are angularly positioned with each other when the collapsible structure is in the expanded position.

According to another aspect of the present invention there is provided a collapsible structure wherein a second frame member is hingedly connected to the first frame member, and wherein a third frame member is connected to the first frame member and the second frame member.

According to an embodiment of the present invention there is provided a collapsible structure having means for hingedly interconnecting the first and second segments. The pivot means may be a bridge or a hinged bridge. The bridge and at least one of the first and second segments includes a snap-fit configuration, so that at least one of the first and second segments can be locked to the bridge when the collapsible structure is in the expanded position.

According to a further embodiment of the present invention there is provided a collapsible structure comprising lock means for locking the first and second segments of the first frame member when the collapsible structure is in the expanded position. The lock means may be in the form of a clip.

According to a further aspect of the present invention there is provided a collapsible structure comprising a first frame member including first and second segment hingedly interconnected with each other allowing the collapsible structure to have a collapsed position and an expanded position; and a second frame member connected to the first frame member, the second frame member including first and second segments hingedly interconnected with each other allowing the collapsible structure to have the collapsed position and the expanded position.

According to a further aspect of the present invention there is provided a collapsible structure comprising a first frame member including a first closed-loop configuration and first and second segments hingedly interconnected with each other allowing the collapsible structure to have a collapsed position and an expanded position; and a second frame member hingedly connected to the first frame member, the second frame member and a portion of the first frame member comprises a second closed-loop configuration, the second frame member including first and second segments hingedly interconnected with each other allowing the collapsible structure to have the collapsed position and the expanded position.

According to a further aspect of the invention, there is provided a collapsible structure comprising a frame foldable between an open position and a collapsed position, the frame in the open position defining an enclosure, the frame further comprising foldable frame members having hinges provided at selected positions; the hinges in the open position adapted to support said frame members in an open position, the hinges in the folded position adapted to allow the structure to fold into a panel-like object for easy of storage and handling. In the preferred embodiment, the collapsible structure wherein the structure is a triangular or quadrilateral shape in the open position. The embodiments according to the present invention provide a collapsible structure which can be folded into a fully collapsed configuration and remains in such fully collapsed configuration without using any holding or fastening means.

BRIEF DESCRIPTION OF THE DRAWINGS

Specific embodiments of the invention will now be described by way of example with reference to the accompanying drawings wherein:

FIG. 2-1 shows a collapsible structure, such as a tent or a children playhouse, with hinge mechanisms incorporated therein according to an embodiment of the present invention;

FIGS. 2A-1 to 2E-1 show the frame of the collapsible structure and the steps of folding the collapsible structure of FIG. 2-1;

DETAILED DESCRIPTION OF THE INVENTION

Figure 1:
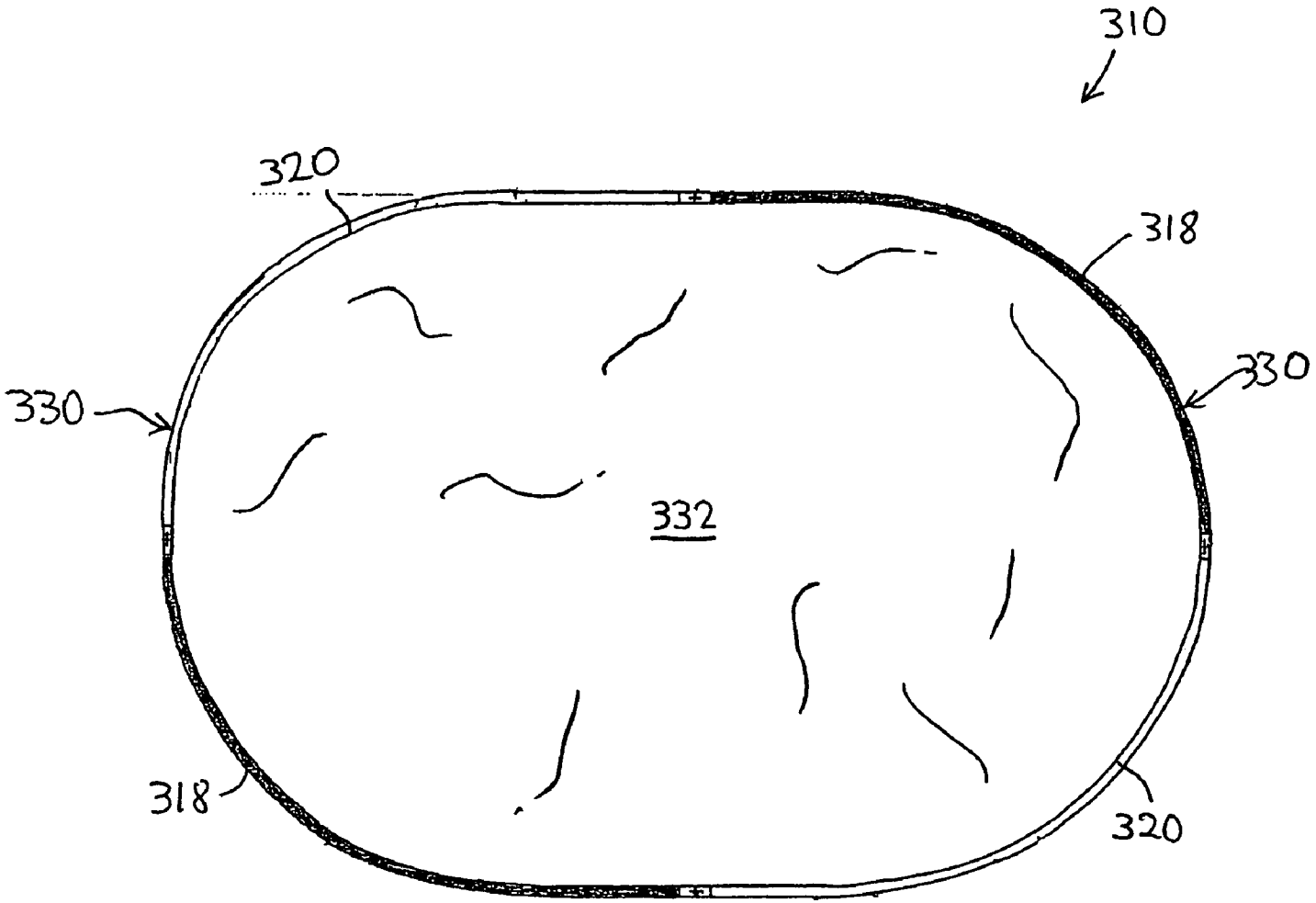
FIG. 1 shows a foldable structure, such as an automobile sun shield or a beach mat, with hinge mechanisms incorporated therein according to an embodiment of the present invention.

Referring now to the drawings, in which like reference numerals represent like parts throughout the drawings, FIG. 1 shows a foldable structure 310, such as an automobile sun shield or a beach mat, with hinge mechanisms incorporated therein according to an embodiment of the present invention. A fabric material 332, or any other suitable materials, is mounted on the foldable structure 310.

Figure 1A:
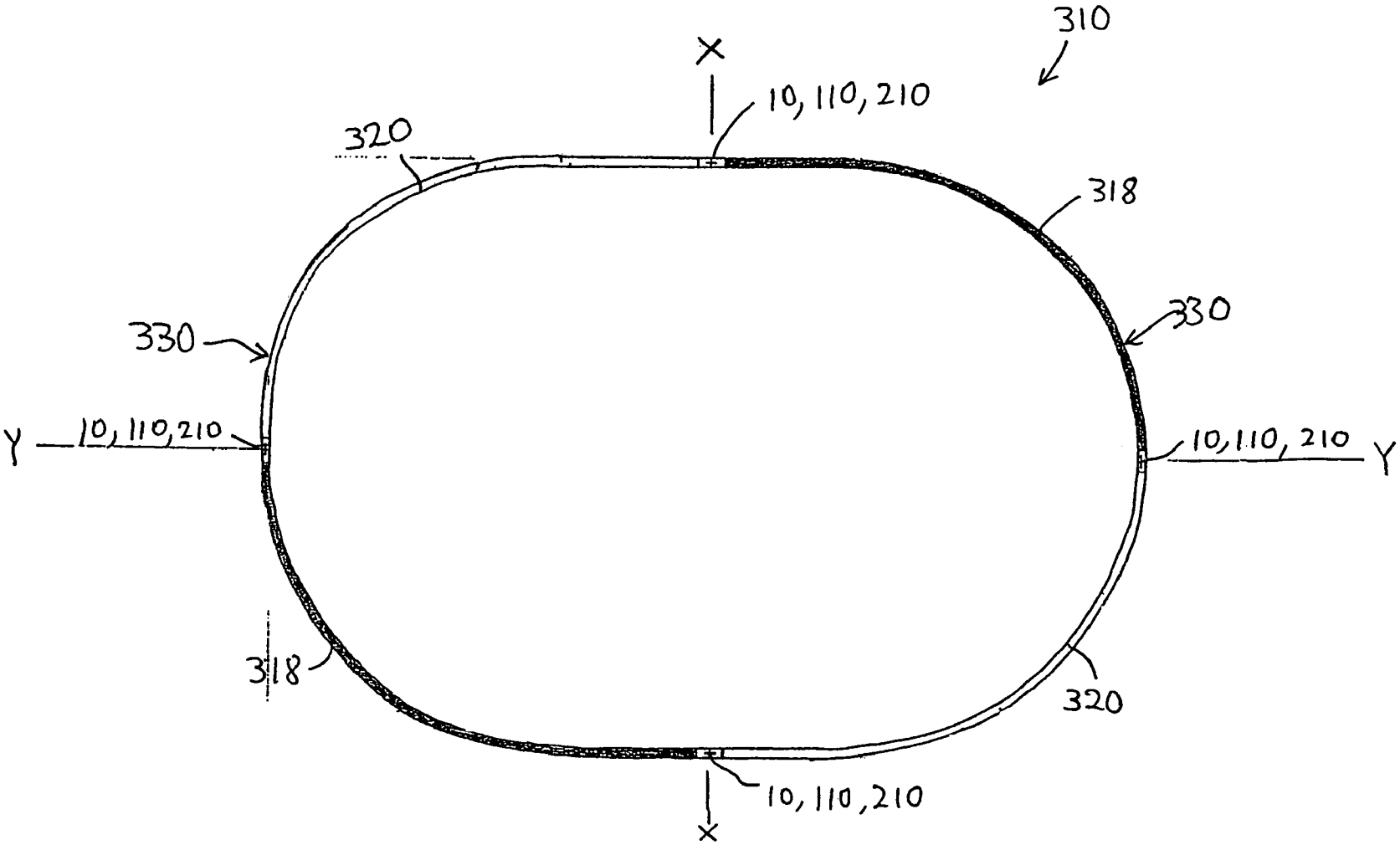
FIGS. 1A-1C show the frame of the foldable structure and the steps of folding the foldable structure of FIG. 1.
Figure 1B:
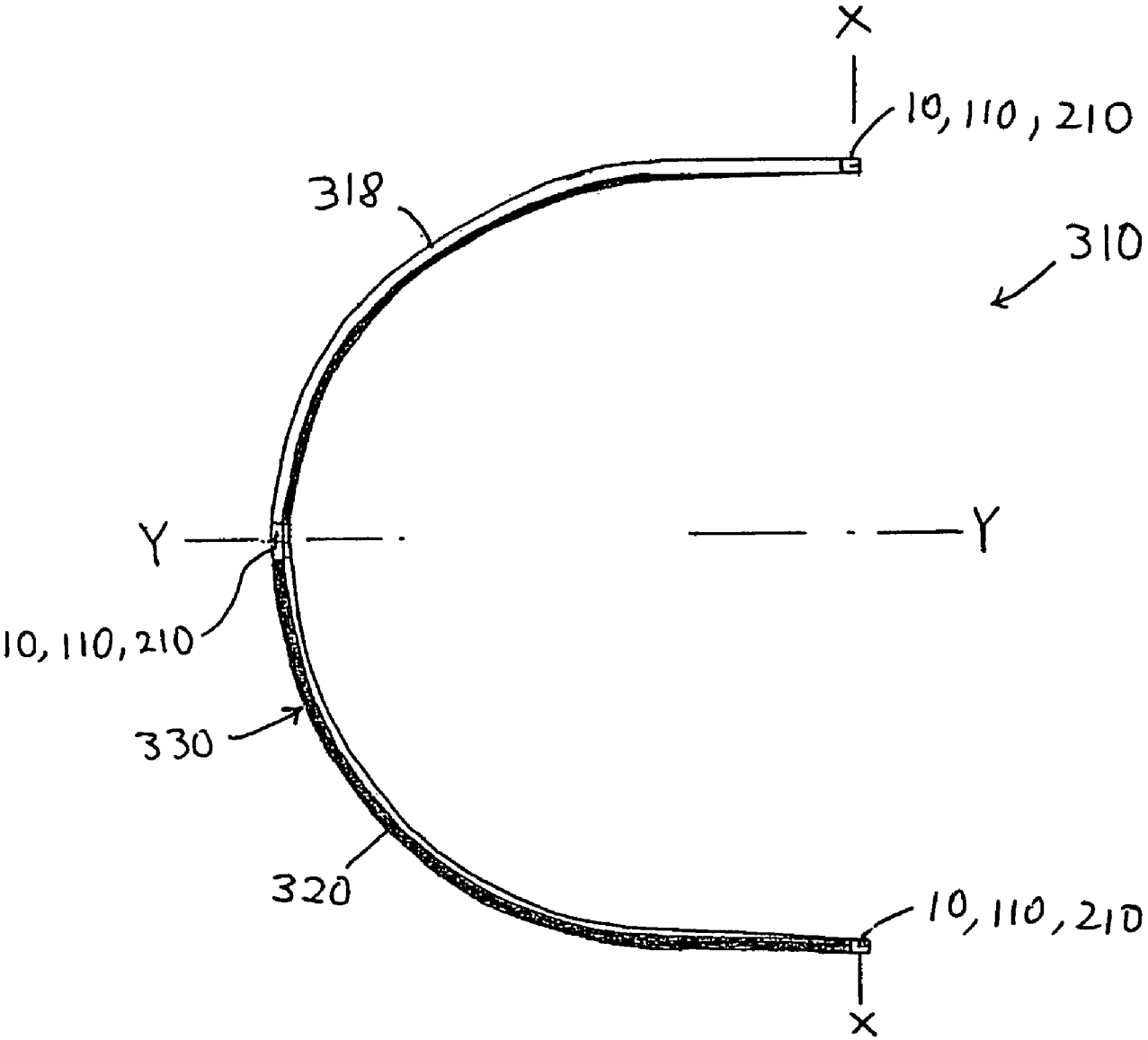
Figure 1C:
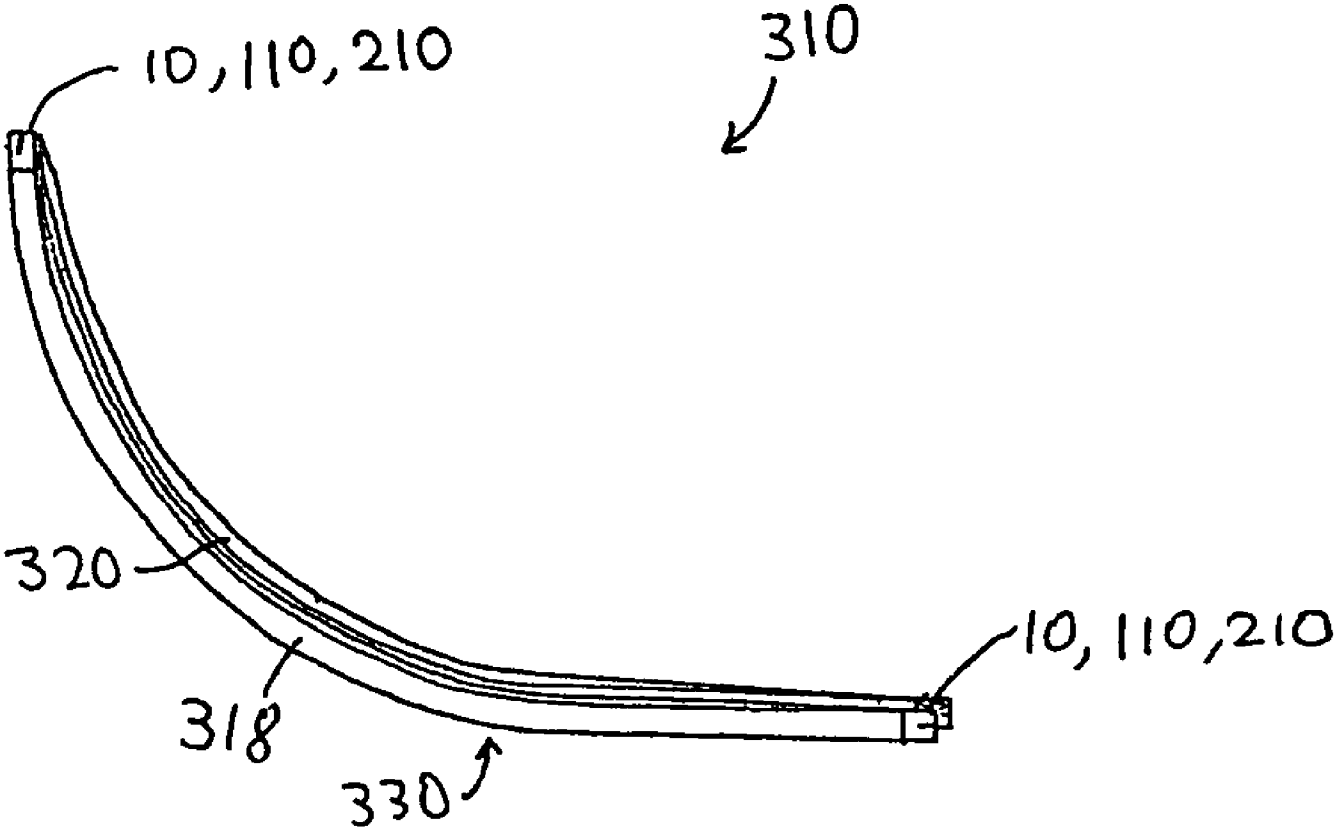

FIGS. 1A-1C show the frame of the foldable structure 310 and the steps of folding the foldable structure 310.

In accordance with one embodiment of the present invention, the foldable structure 310 has two U-shaped frame members 330, 330 each including first and second curved frame segments 318, 320. The two U-shaped frame members 330, 330 are substantially identical in shape.

The first and second curved frame segments 318, 320 of each frame member 330 are hingedly connected together by hinge mechanisms 10, 110, 210, details of which will be described later.

The ends of the two frame members 330, 330 are also hingedly connected by hinge mechanisms 10, 110, 210, as illustrated in FIG. 1A, to form a closed loop.

To fold the foldable structure 310, the foldable structure 310 is first folded up along X-axis such that the two U-shaped frame members 330, 330 are in a superimposed relationship, as shown in FIG. 1B. Then, the two frame members 330, 330 are folded along Y-axis to form a final folded up structure, as shown in FIG. 1C.

Figure 2:
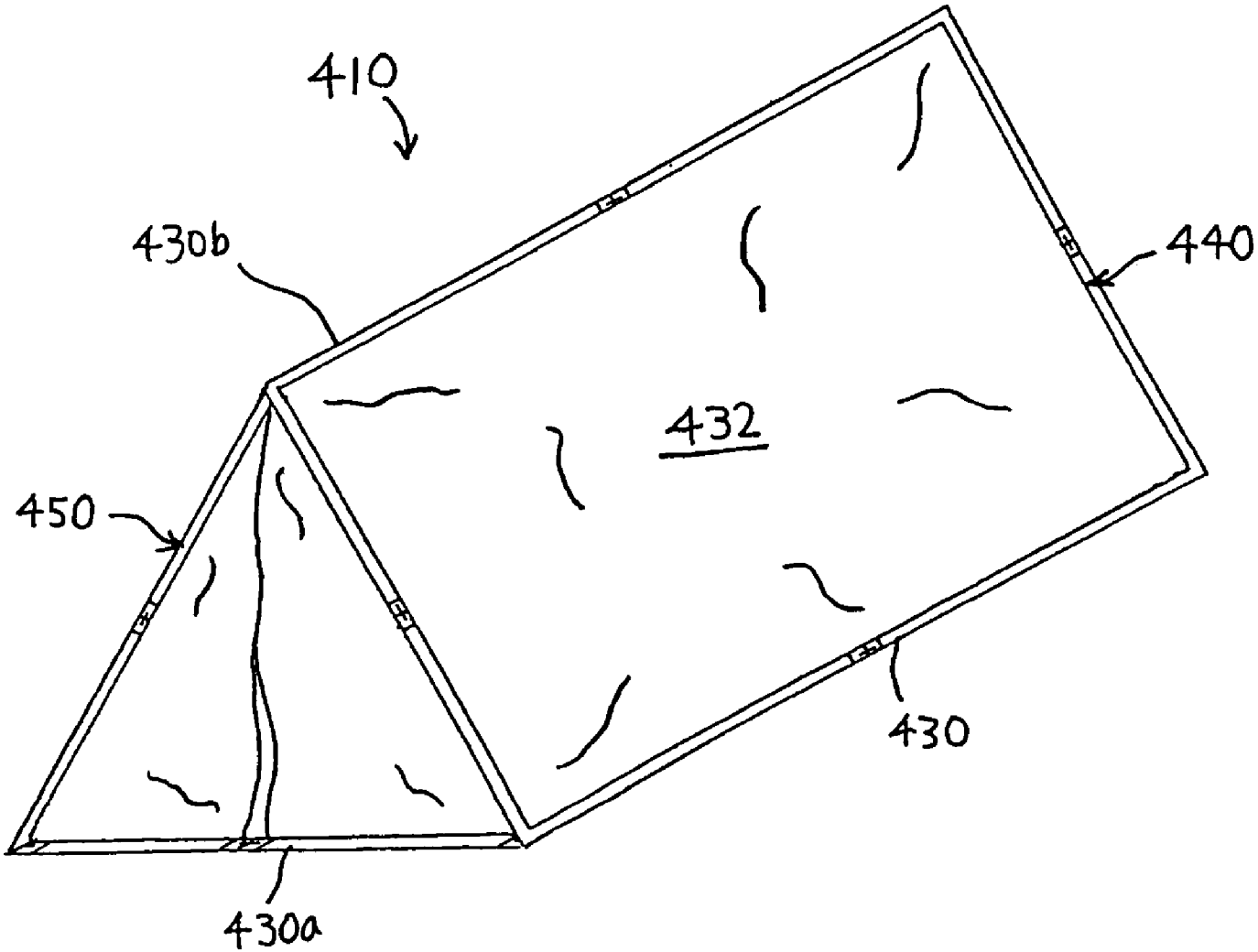
FIG. 2 shows a collapsible structure, such as a tent or a children playhouse, with hinge mechanisms incorporated therein according to an embodiment of the present invention.

FIG. 2 shows a collapsible structure 410, such as a tent or a children playhouse, with hinge mechanisms incorporated therein according to an embodiment of the present invention. A fabric material 432, or any other suitable materials, is mounted on the collapsible structure 410.

FIGS. 2A-2E show the frame of the collapsible structure 410 and the steps of folding the collapsible structure 410.

According to a preferred embodiment of the invention, the collapsible structure 410 has a rectangular ground-engaging frame structure. The rectangular ground-engaging frame structure includes two square-bracket shaped frame members 430, 430 and two transversely extending frame members 430*a*, 430*a*.

Each of the two square-bracket shaped frame members 430, 430 includes first and second L-shaped frame segments 418, 420 hingedly connected to each other by a hinge mechanism 10, 110, 210, as described hereinbelow.

Each of the two transversely extending frame members 430*a*, 430*a* includes first and second elongated frame segments 418', 420' hingedly connected to each other by a hinge mechanism 10, 110, 210.

The free ends of each square-bracket shaped frame member 430 are hingedly connected to respective free ends of an upper square-bracket shaped frame member 430*b* forming two slanted side frames 440, 450 of the collapsible structure 410. Each of the side frames 440, 450 is in a closed loop configuration. The L-shaped frame segments 418, 420 and the elongated frame segments 418', 420' are angularly positioned with each other.

Each square-bracket shaped frame member 430 is hingedly connected to the two transversely extending frame members 430*a*, 430*a* by conventional connecting means such as conventional hinges. Also, the two upper square-bracket shaped frame members 430*b*, 430*b* are hingedly connected to each other by conventional connecting means such as conventional hinges.

Figure 2A:
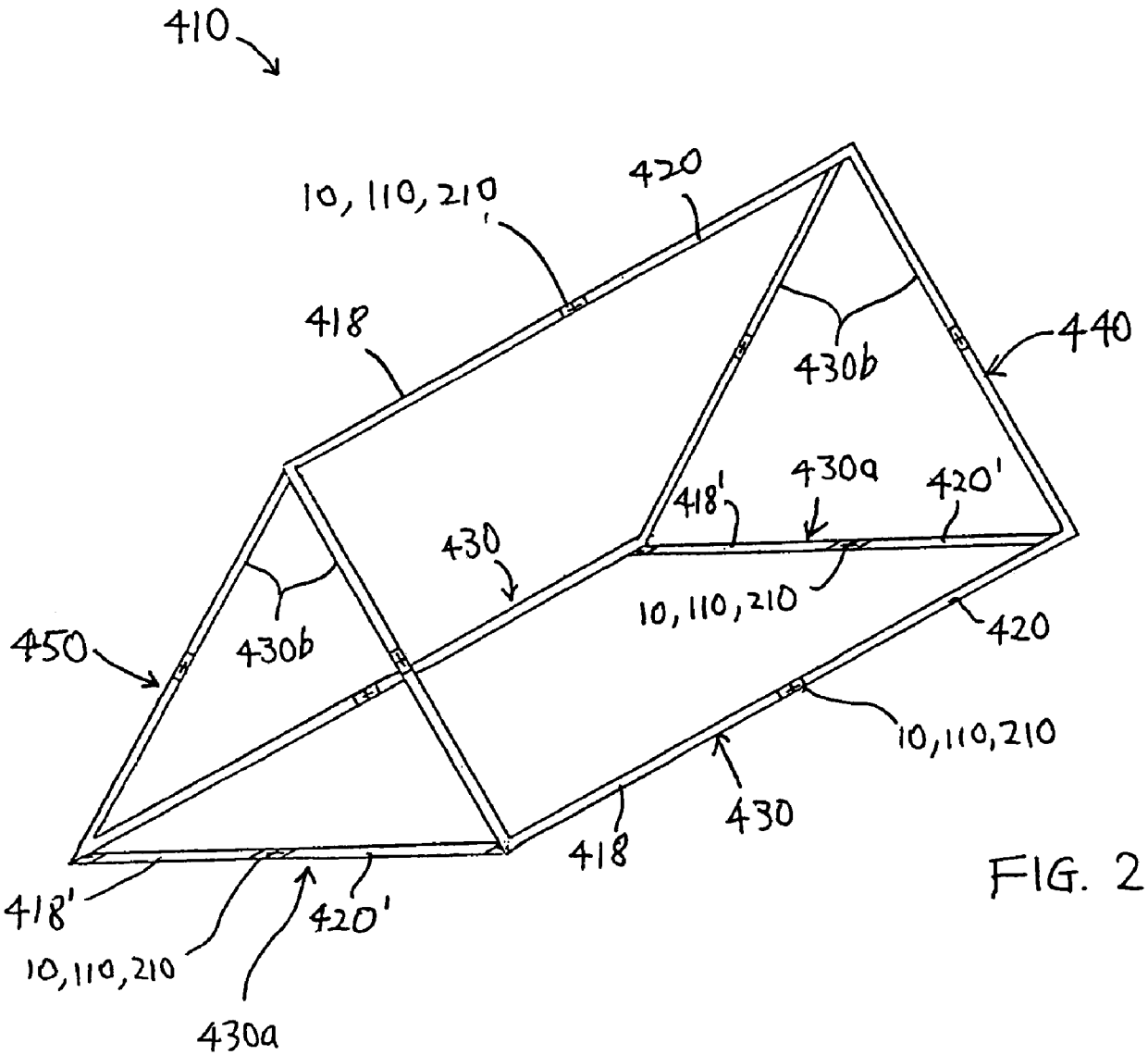
FIGS. 2A-2E show the frame of the collapsible structure and the steps of folding the collapsible structure of FIG. 2.
Figure 2B:
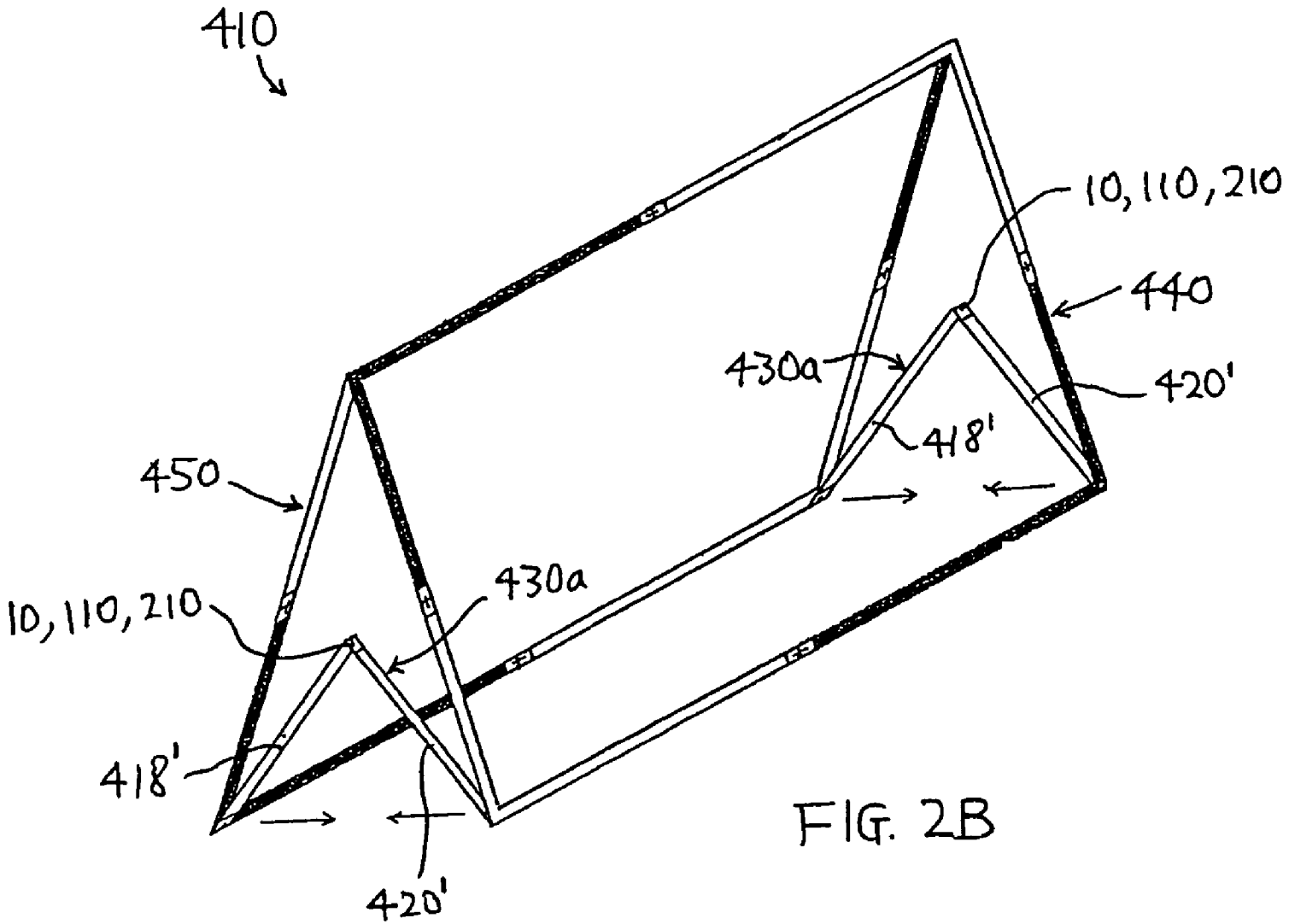
Figure 2C:
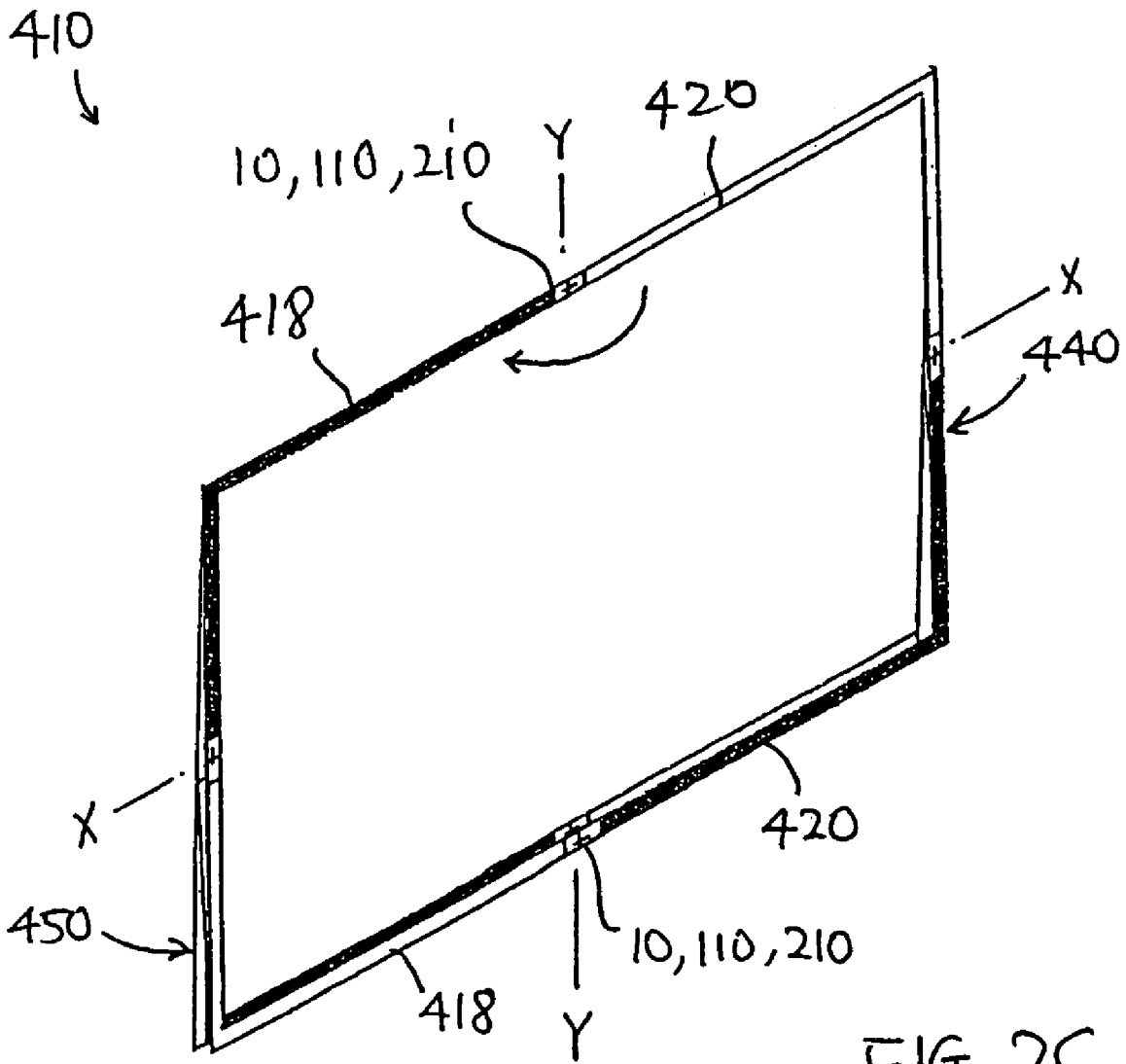

To collapse the collapsible structure 410, the two transversely extending frame members 430*a*, 430*a* are first folded up thereby bringing the two slanted side frames 440, 450 towards each other, as shown by the arrows in FIG. 2B, until the two slanted side frames 440, 450 are superimposed, as shown in FIG. 2C.

Figure 2D:
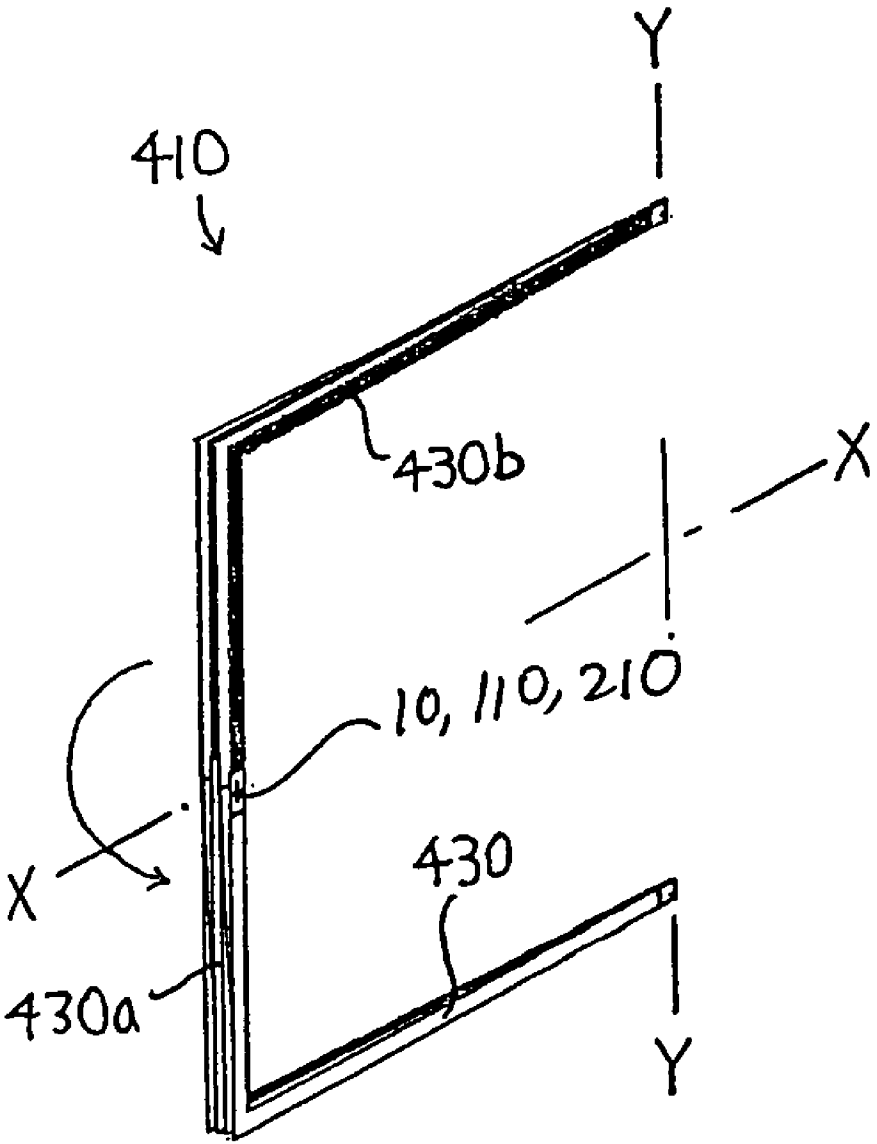

The two superimposed side frames 440, 450 are then folded up along Y-axis, as shown in FIG. 2D. The structure 410 is further folded up along X-axis to form a final L-shaped collapsed structure, as shown in FIG. 2E.

Figure 2E:
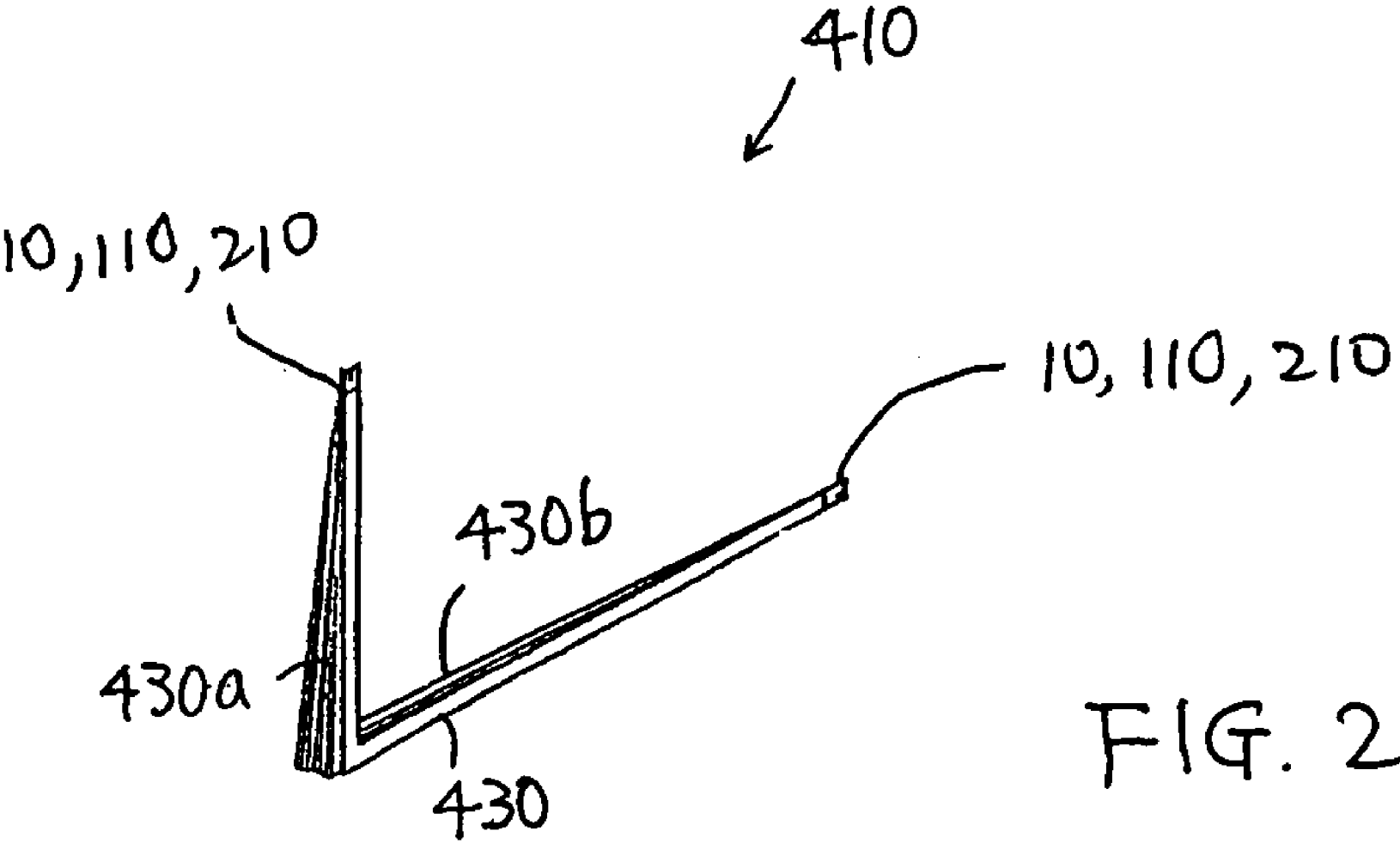
Figures 1, 2:
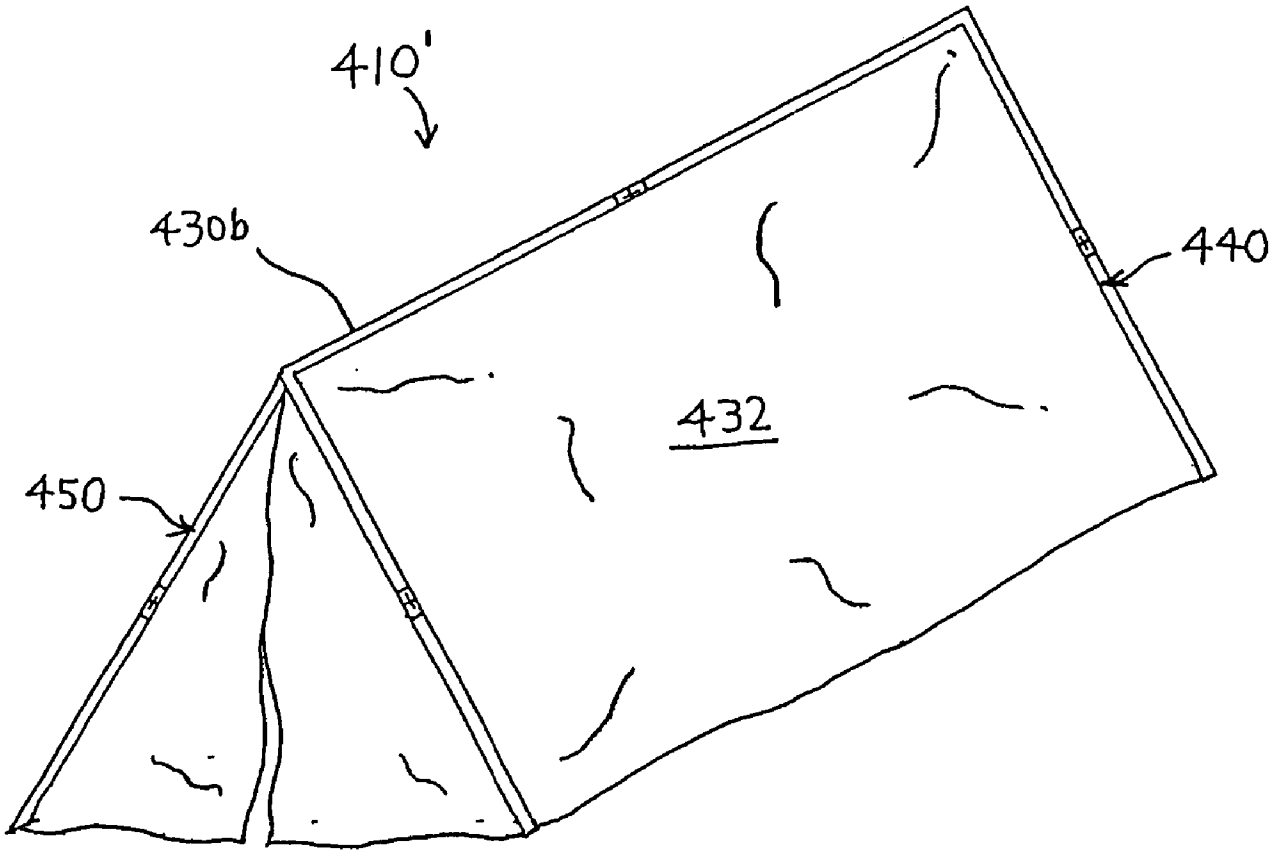
Figures 1, 2A:
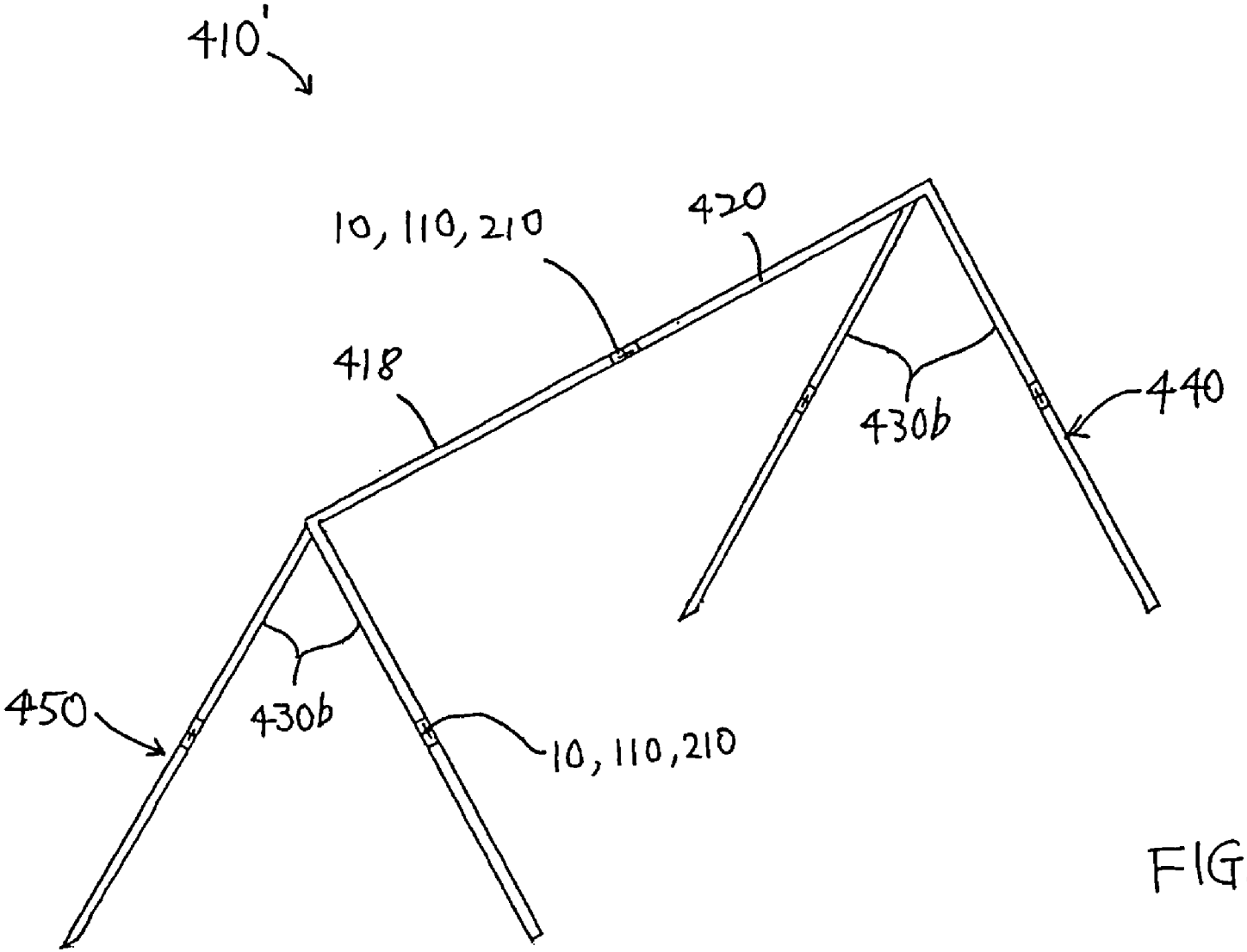
Figures 1, 2B:
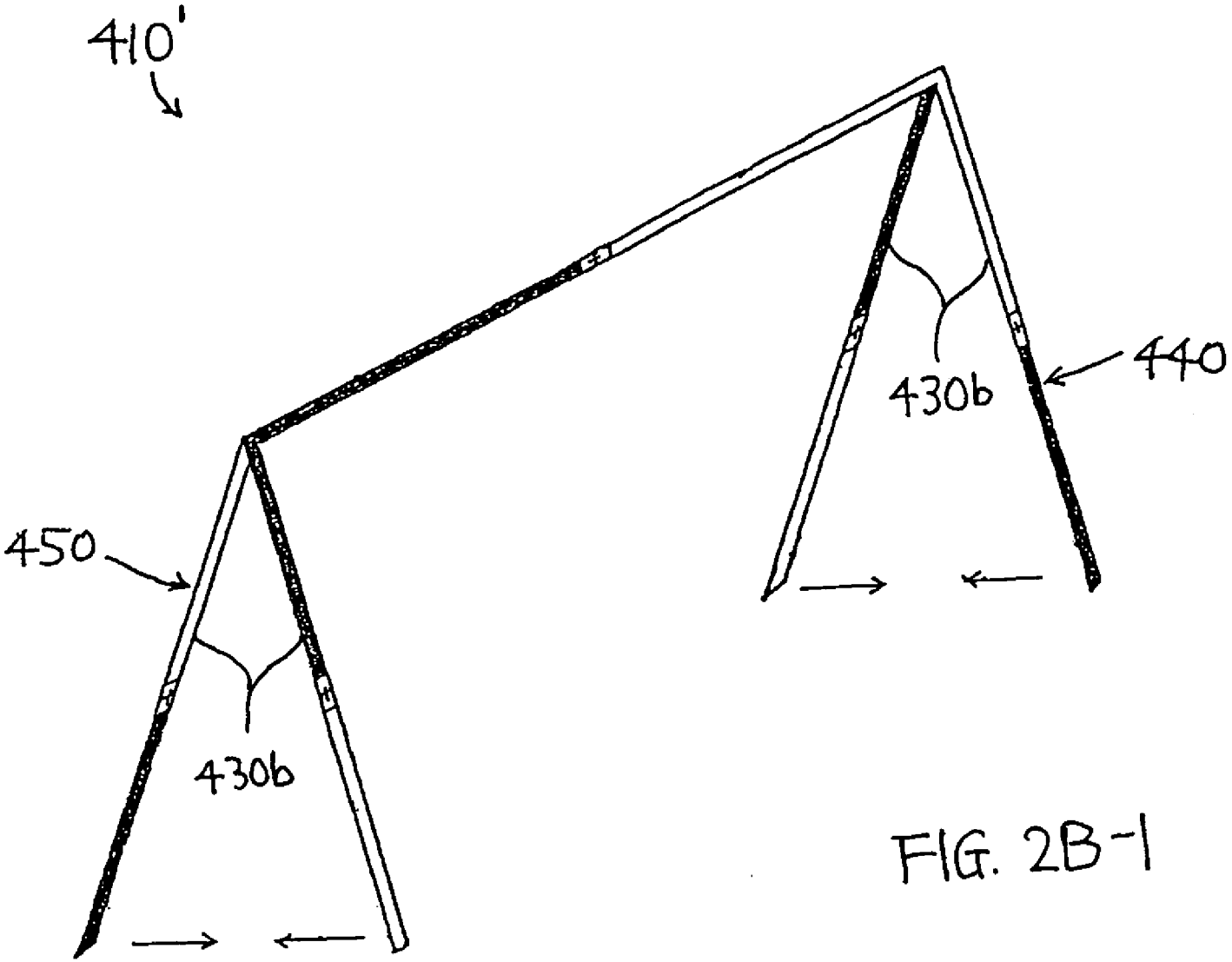
Figures 1, 2C:
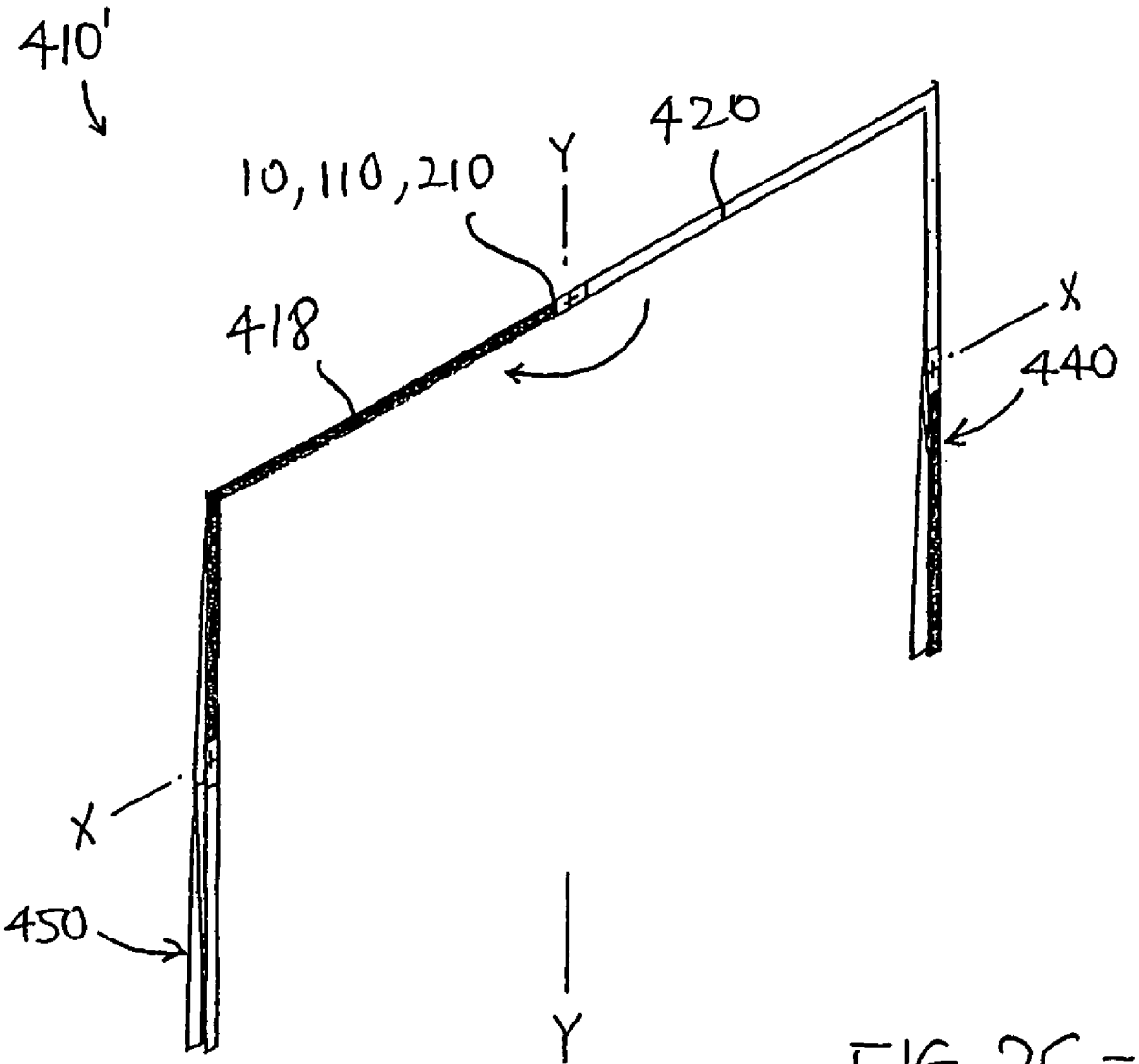
Figures 1, 2D:
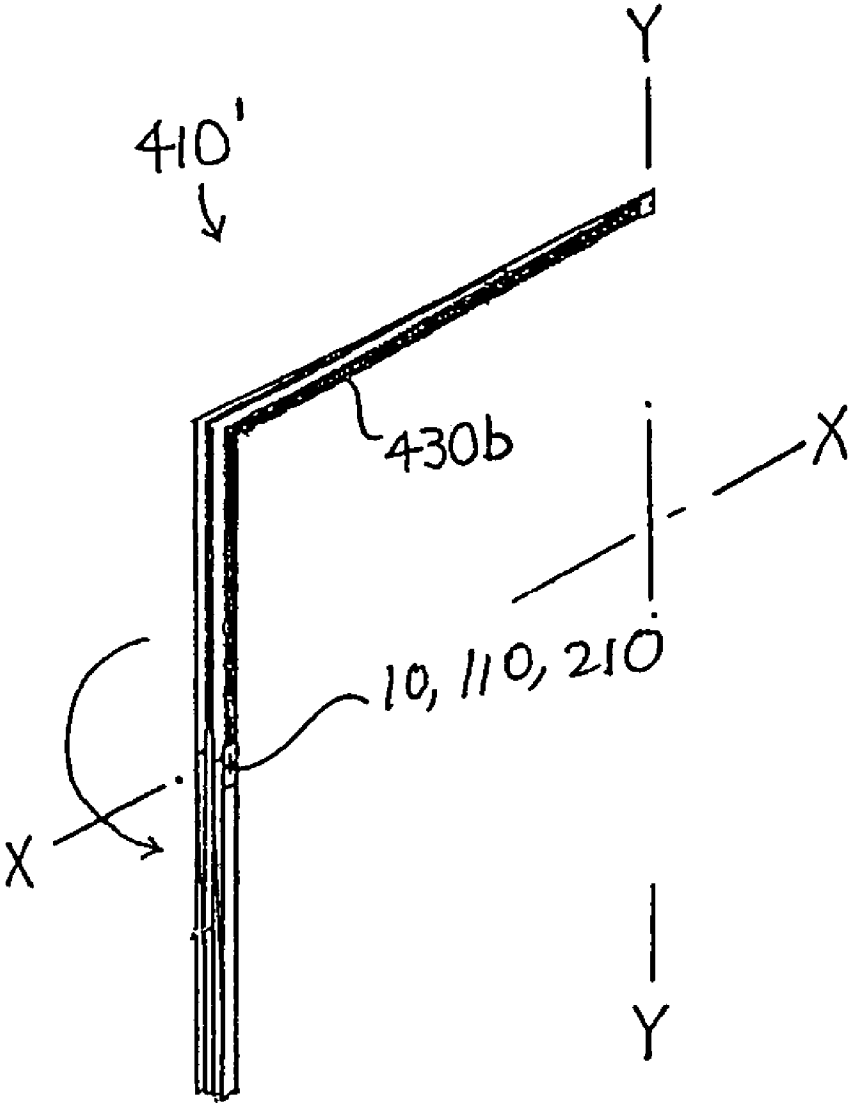
Figures 1, 2E:
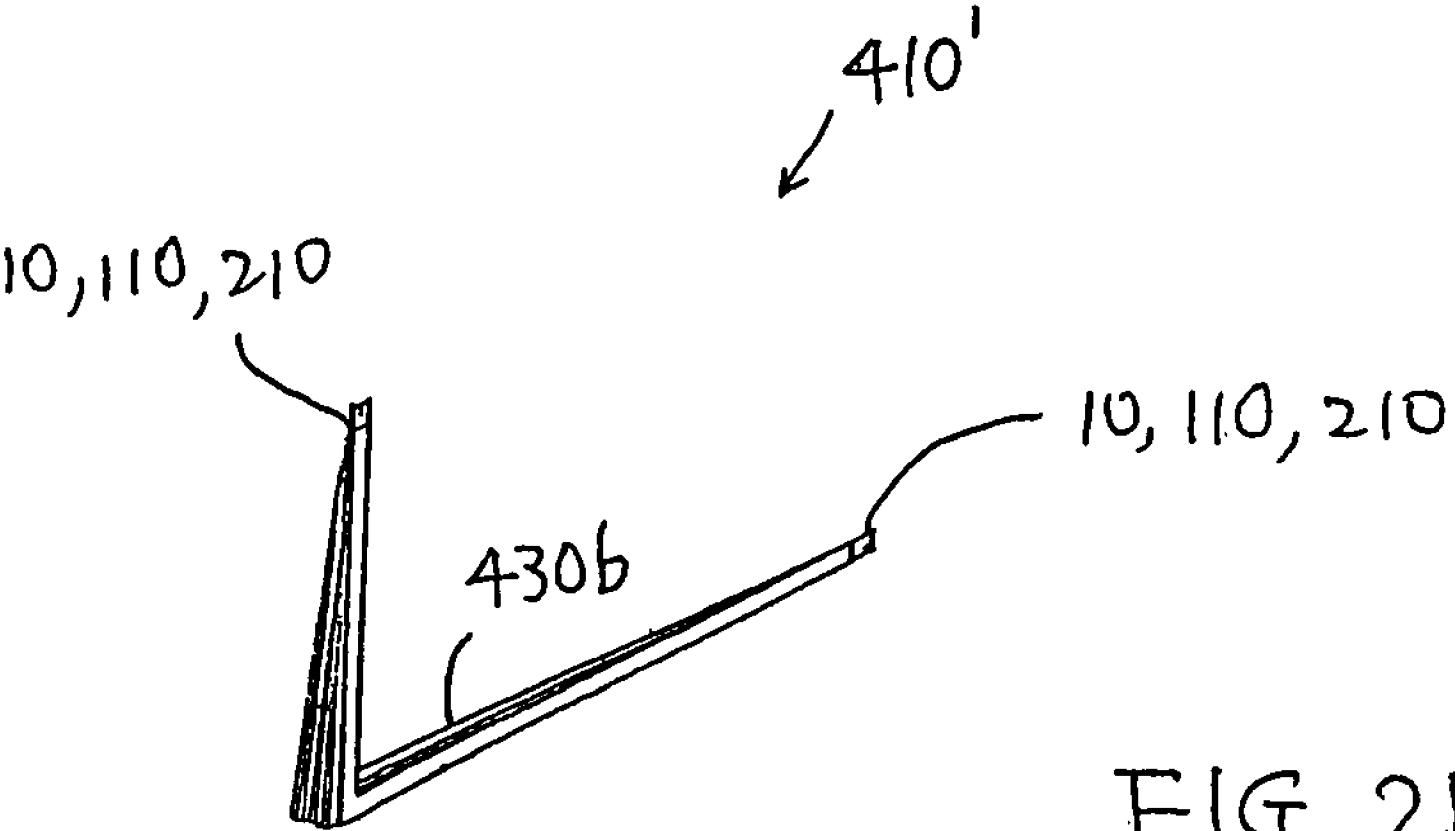

In summary, the collapsible structure 410 comprises a frame foldable between an open position, as shown in FIG. 2A, and a collapsed position, as shown in FIG. 2E. The frame in the open position defines an enclosure with two slanted sides and two vertical sides. The frame further comprises foldable frame members 418, 420, 418', 420' having hinges 10, 110, 210 provided at selected positions. The hinges 10, 110, 210 in the open position adapted to support the frame members 418, 420, 418', 420' in an open position. The hinges 10, 110, 210 in the folded position adapted to allow the structure to fold into a panel-like object for easy storage and handling. The collapsible structure 410 is a triangular shape in the open position.

FIG. 2-1 shows a collapsible structure 410', such as a tent or a children playhouse, with hinge mechanisms incorporated therein according to an embodiment of the present invention. A fabric material 432, or any other suitable materials, is mounted on the collapsible structure 410'.

FIGS. 2A-1 to 2E-1 show the frame of the collapsible structure 410' and the steps of folding the collapsible structure 410'.

The frame of the collapsible structure 410' is the same as the frame of the collapsible structure 410 previously described except that the frame of the collapsible structure 410' does not have the rectangular ground-engaging frame members 430, 430*a*.

Therefore, the frame of the collapsible structure 410' is not in a closed-loop configuration.

To collapse the collapsible structure 410', the two slanted side frames 440, 450 are first folded up towards each other, as shown by the arrows in FIG. 2B-1, until the two slanted side frames 440, 450 are superimposed, as shown in FIG. 2C-1.

The two superimposed side frames 440, 450 are then folded up along Y-axis, as shown in FIG. 2D-1. The structure 410 is further folded up along X-axis to form a final L-shaped collapsed structure, as shown in FIG. 2E-1.

In summary, the collapsible tent structure 410' comprises a frame foldable between an open position, as shown in FIG. 2A-1, and a folded position, as shown in FIG. 2E-1. In the open position, the frame and the fabric material mounted thereon define an enclosure therein. The frame and the fabric material can be folded into a panel-like object for easy storage and handling. This panel-like object is generally in the form of a flat panel. The thickness of the panel-like object is substantially equal to the thickness of the superimposed frames of the folded tent structure. The size of the panel-like object is about one-fourth of the size of the side frame of the tent structure.

Figure 3:
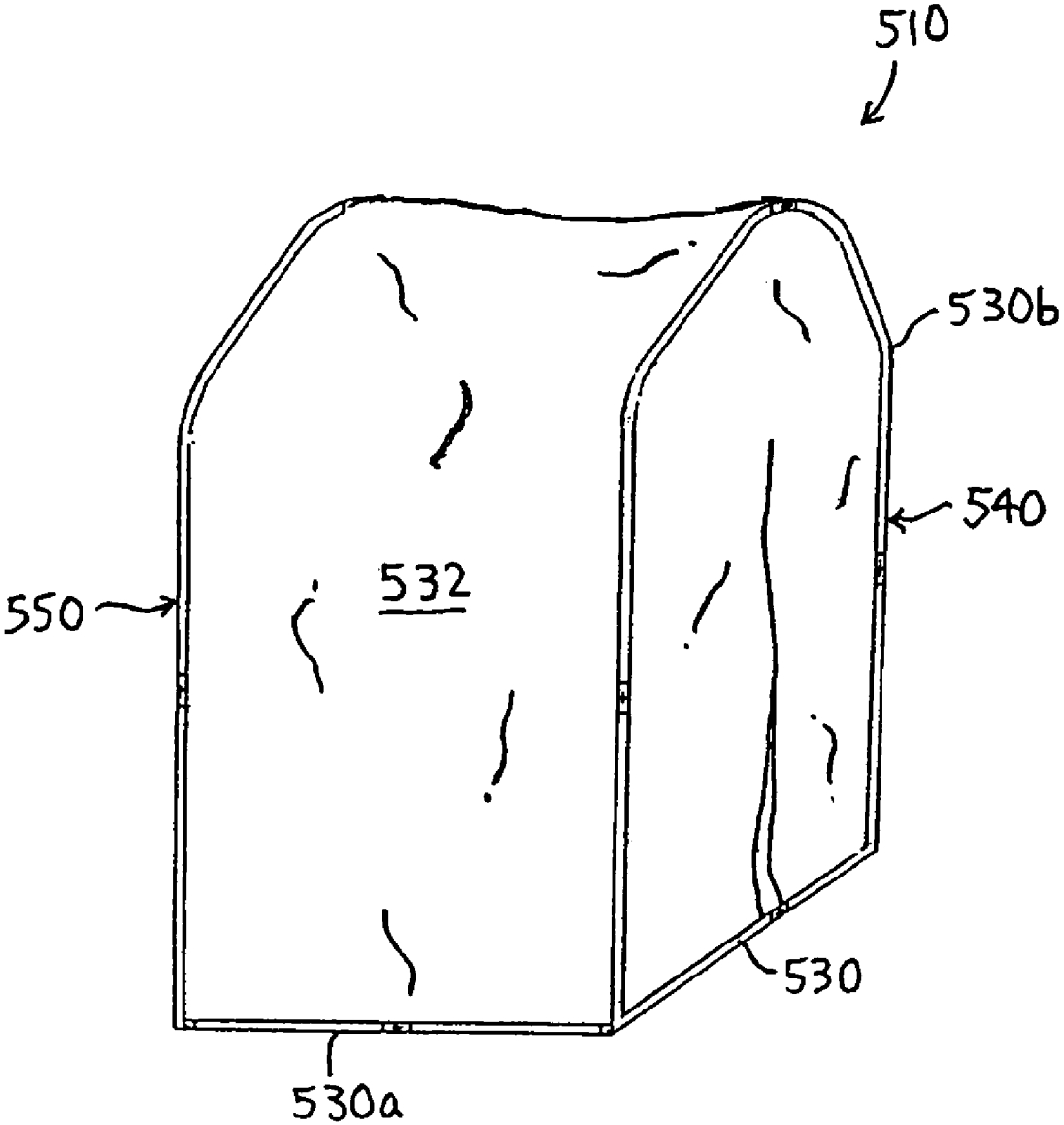
FIG. 3 shows a collapsible structure, such as a pavilion or a children playhouse, with hinge mechanisms incorporated therein according to an embodiment of the present invention.

FIG. 3 shows a collapsible structure 510, such as a pavilion or a children playhouse, with hinge mechanisms incorporated therein according to an embodiment of the present invention. A fabric material 532, or any other suitable materials, is mounted on the collapsible structure 510.

FIGS. 3A-3F show the frame of the collapsible structure 510 and the steps of folding the collapsible structure 510.

According to a preferred embodiment of the invention, the collapsible structure 510 has a rectangular ground-engaging frame structure. The rectangular ground-engaging frame structure includes two square-bracket shaped frame members 530, 530 and two lower transversely extending frame members 530*a*, 530*a*.

Each of the two square-bracket shaped frame members 530, 530 includes first and second L-shaped frame segments 518, 520 hingedly connected to each other by a hinge mechanism 10, 110, 210, as described hereinbelow.

Each of the two lower transversely extending frame members 530*a*, 530*a* includes first and second elongated frame segments 518', 520' hingedly connected to each other by a hinge mechanism 10, 110, 210.

The free ends of each square-bracket shaped frame member 530 are hingedly connected to respective free ends of an upper arch shaped frame member 530*b* forming two vertical side frames 540, 550 of the collapsible structure 510. Each of the two side frames 540, 550 is in a closed loop configuration. The L-shaped frame segments 518, 520 and the elongated frame segments 518', 520' are angularly positioned with each other at about 90 degrees. The elongated frame segments 518', 520' are angularly positioned with each other at about 180 degrees.

The two upper arch shaped frame member 530*b*, 530*b* are hingedly connected together by two upper transversely extending frame members 530*d*, 530*d*.

Each square-bracket shaped frame member 530 is hingedly connected to the two transversely extending frame members 530*a*, 530*a* by conventional connecting means such as conventional hinges. Similarly, each square-bracket shaped frame member 540 is hingedly connected to the two transversely extending frame members 530*d*, 530*d* by conventional connecting means such as conventional hinges.

Figure 3A:
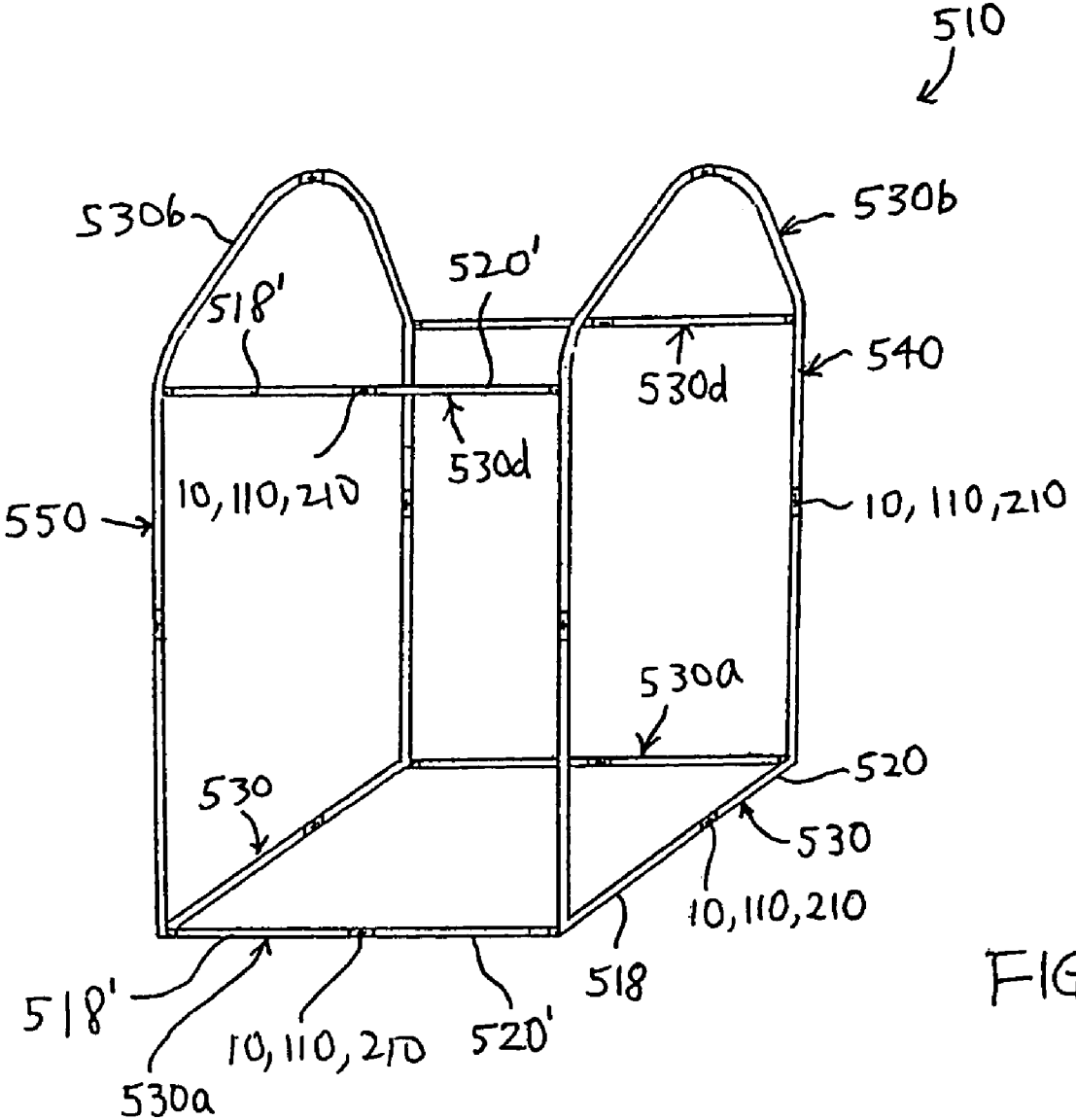
FIGS. 3A-3F show the frame of the collapsible structure and the steps of folding the collapsible structure of FIG. 3.
Figure 3B:
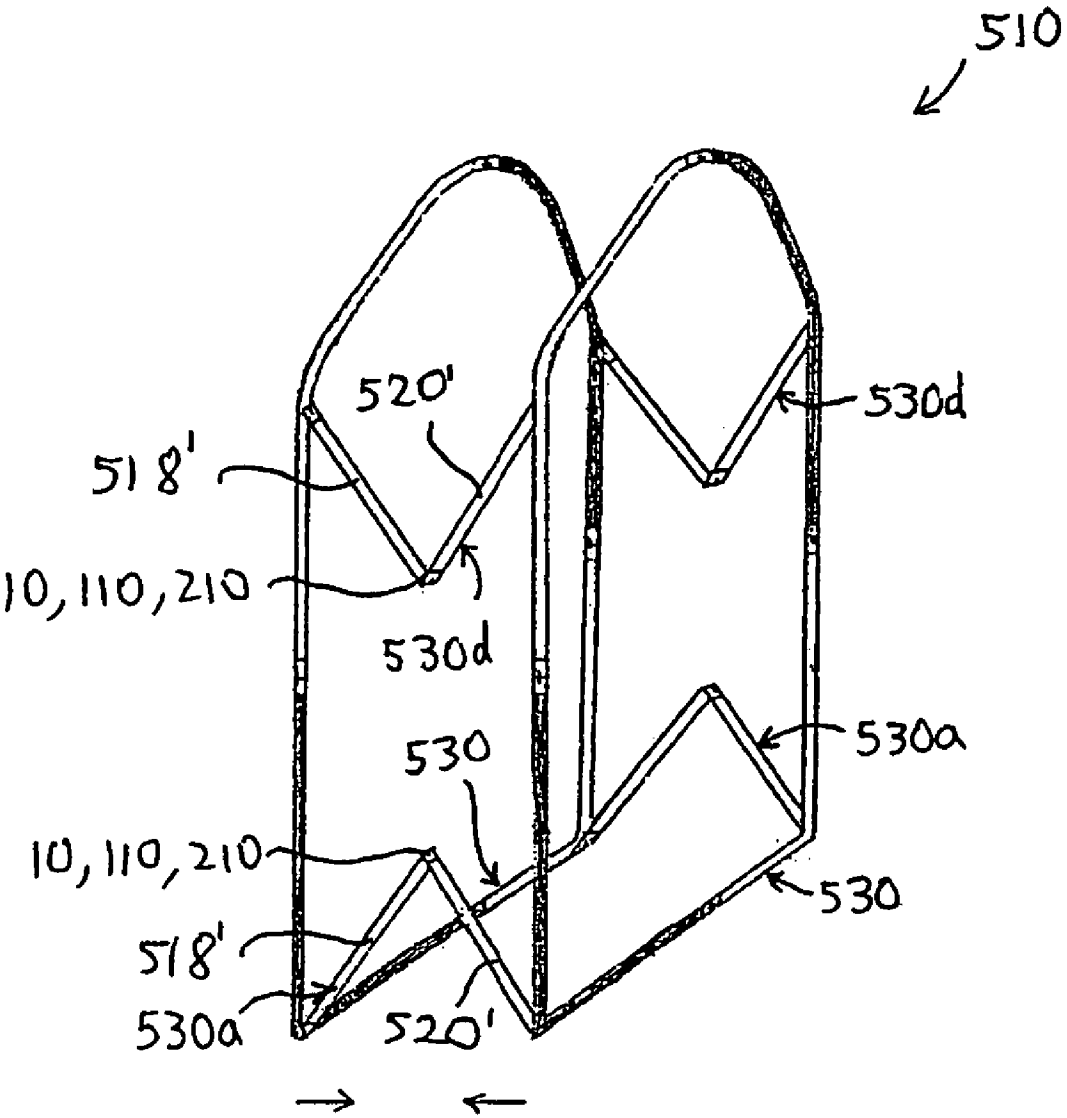
Figure 3C:
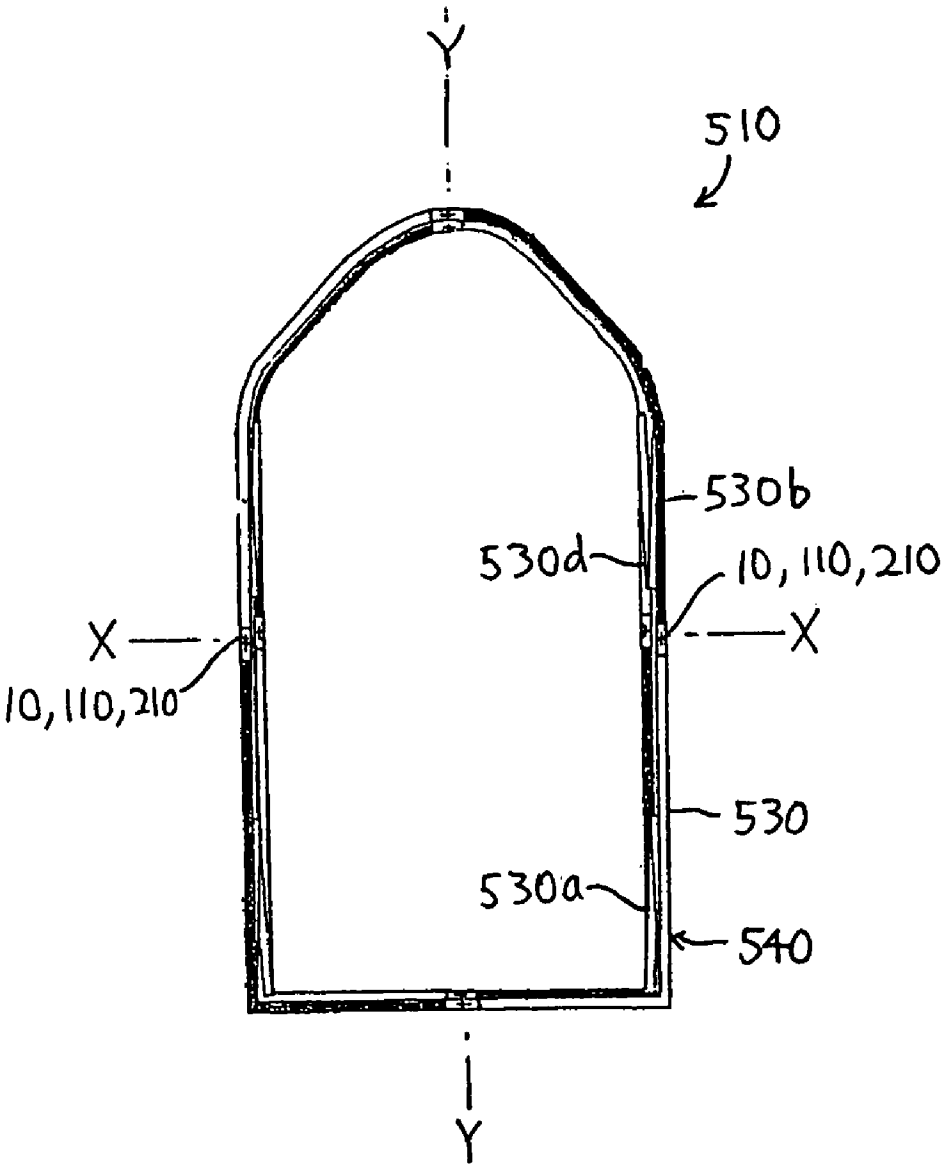

To collapse the collapsible structure 510, the four transversely extending frame members 530*a*, 530*d* are first folded thereby bringing the two vertical side frames 540, 550 towards each other, as shown by the arrows in FIG. 3B, until the two vertical side frames 540, 550 are superimposed, as shown in FIG. 3C.

Figure 3D:
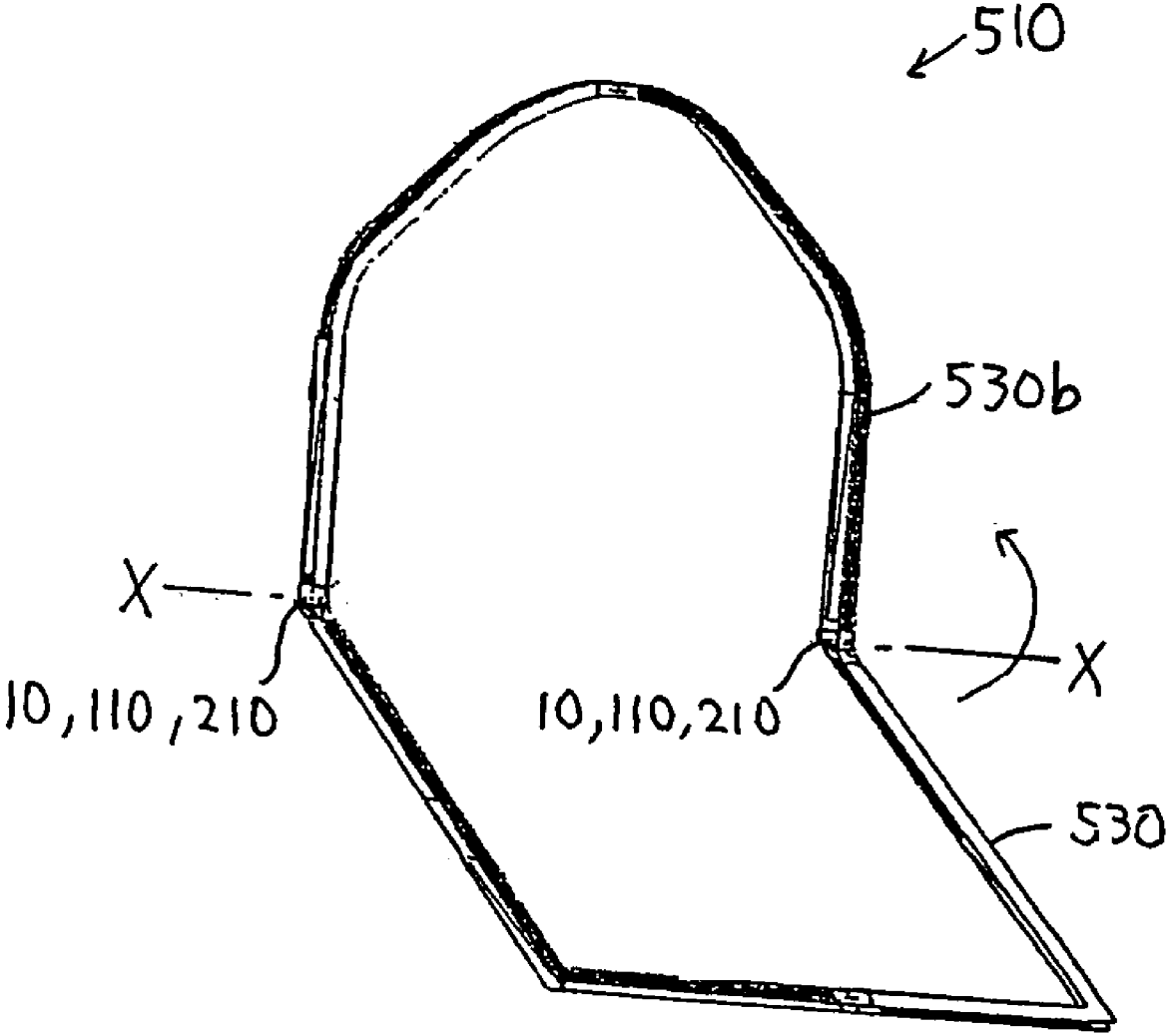
Figure 3E:
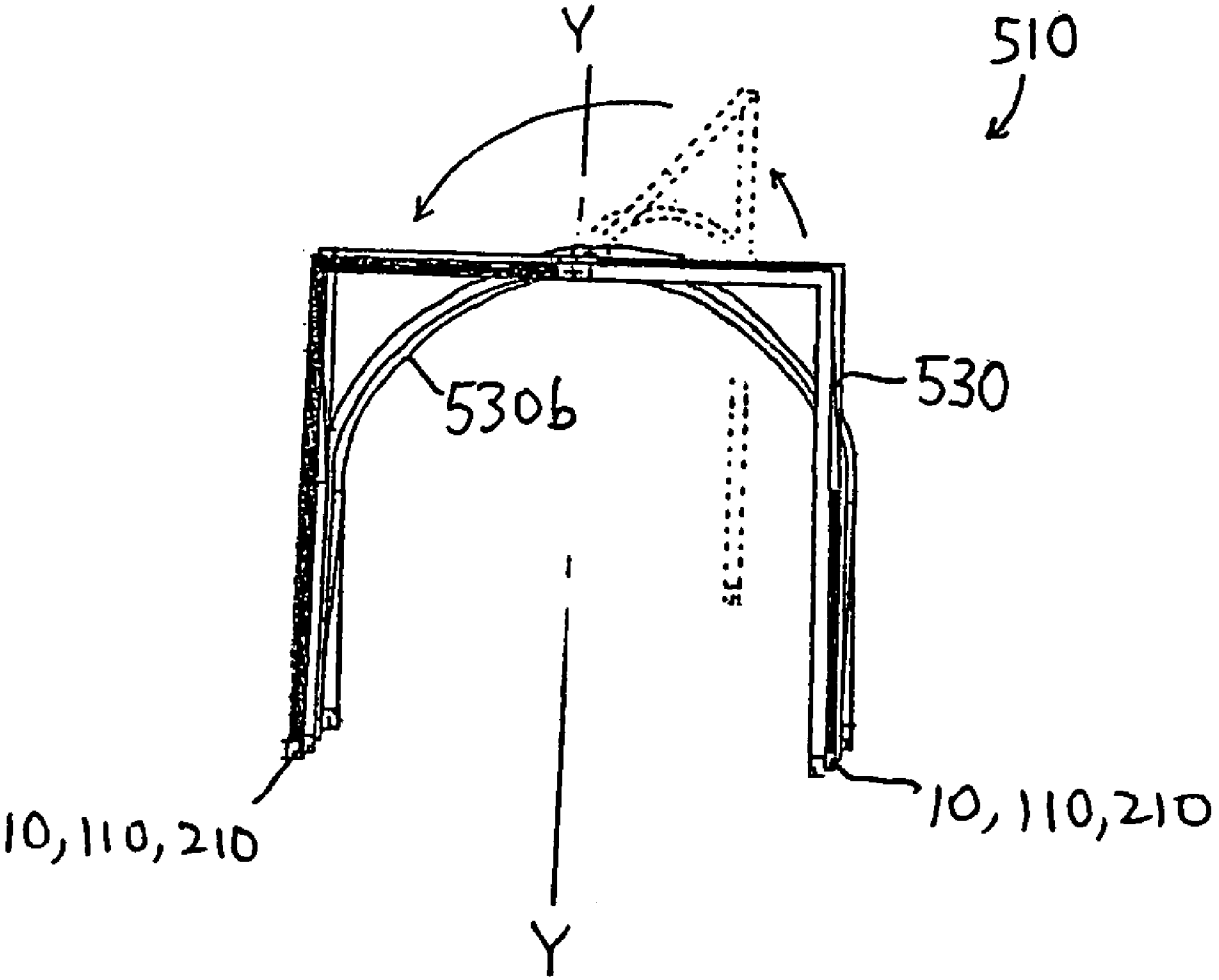

The two superimposed side frames 540, 550 are then folded up along X-axis, as shown in FIGS. 3D and 3E. The structure 510 is further folded up along Y-axis to form a final collapsed structure, as shown in FIG. 3F.

The frame segments 318, 320, 418, 420, 418', 420', 518, 520, 518', 520' of the collapsible structures 310, 410, 510 may be made of plastic, or metal, or any other suitable materials.

Figure 3F:
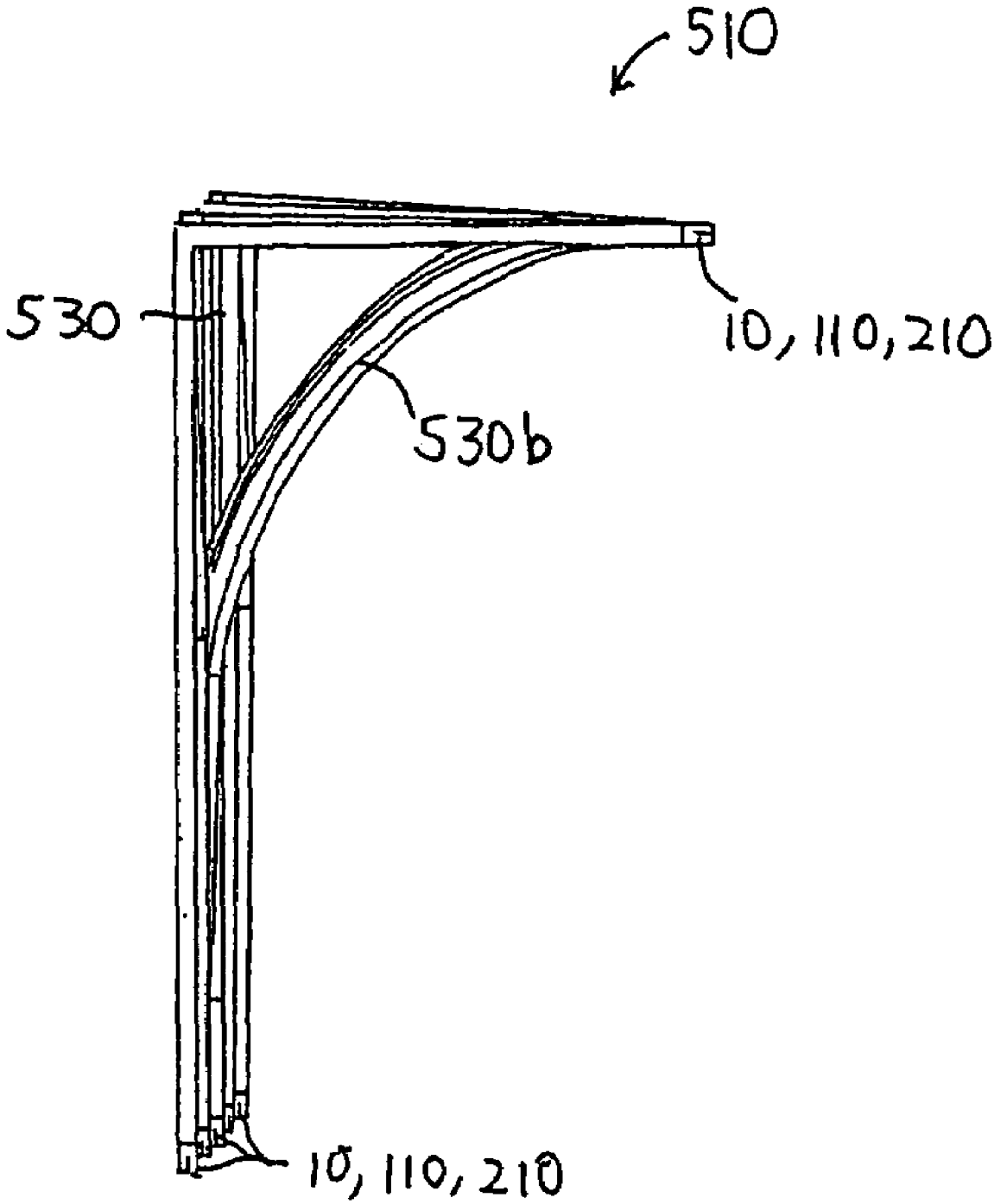

In summary, the collapsible pavilion structure 510 comprises a frame foldable between an open position, as shown in FIG. 3A, and a collapsed position, as shown in FIG. 3F. In the open position, the frame and the fabric material mounted thereon define an enclosure therein. The frame and the fabric material can be folded into a panel-like object for easy storage and handling. This panel-like object is generally in the form of a flat panel. The thickness of the panel-like object is substantially equal to the thickness of the superimposed frames of the folded pavilion structure.

Figure 4:
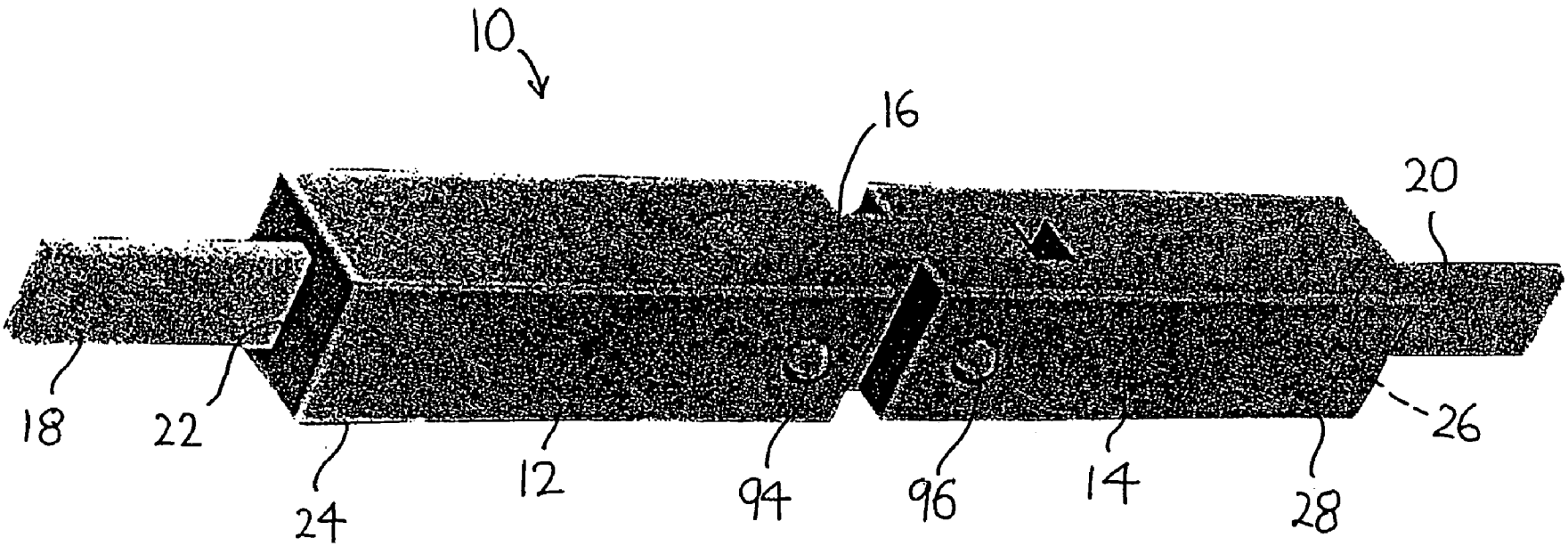
FIG. 4 is a perspective view of a hinge mechanism of a collapsible structure according to a first embodiment of the present invention.

FIG. 4 is a perspective view of a hinge mechanism of a collapsible structure in accordance with a first embodiment of the present invention. The hinge mechanism, generally designated by reference numeral 10, comprises a first hinge segment 12 and a second hinge segment 14.

According to the embodiment of the present invention, the first and second hinge segments 12, 14 are hingedly connected to each other by a bridge member 16.

The hinge mechanism 10 is adapted to hingedly connect the two frame segments 318, 320, 418, 420, 418', 420', 518, 520, 518', 520', collectively represented by reference numerals 18, 20, of the respective collapsible structures 310, 410, 510 hereinbefore described. The frame segments 18, 20 may be in the form of a rod or a strip, as shown in FIG. 4. The hinge mechanism 10 and the frame segments 18, 20 together define a frame member of the collapsible structure.

One end of the frame segment 18 is fixedly secured in a blindhole 22 at one end 24 of the hinge segment 12, and the other end of the frame segment 18 is fixedly secured to a hinge segment of another hinge mechanism. Similarly, one end of frame segment 20 is fixedly secured in a blindhole 26 at one end 28 of the hinge segment 14, and the other end of the frame segment 20 is fixedly secured to a hinge segment of another hinge mechanism.

Figure 5:
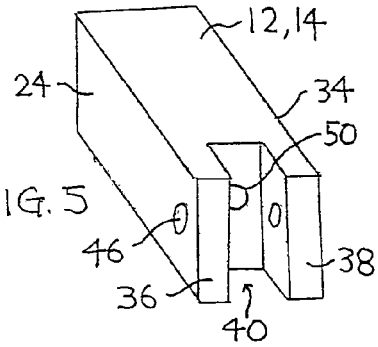
FIG. 5 shows one of the two identical segments of the hinge mechanism of FIG. 4.

FIG. 5 is a perspective view of the hinge segment 12 which is substantially identical to hinge segment 14 of the hinge mechanism 10. According to a preferred embodiment of the invention, the hinge segment 12 has a rectangular cross section.

One end 24 of the hinge segment 12 is adapted to be connected to the frame segment 18, as depicted in FIG. 4. The other end 34 of the hinge segment 12 is provided with two longitudinally extending arms 36, 38. The two arms 36, 38 are spaced apart defining a slot 40 therebetween.

A transversely extending aperture 46 is provided on arm 36. A transversely extending aperture 48, being in alignment with aperture 46, is provided on arm 38.

A central recess 50 is provided at the end 34 of the hinge segment 12 between the arms 36, 38. Details of the usage of the recess 50 will be described later.

Figure 6:
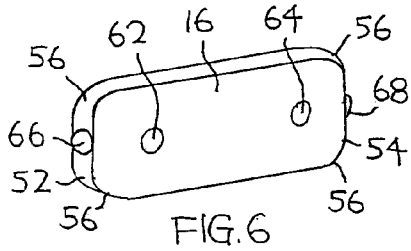
FIG. 6 shows a bridge member of the hinge mechanism of FIG. 4.

FIG. 6 is a perspective view of the bridge 16 of the hinge mechanism 10 in accordance with a preferred embodiment of the invention. The bridge 16 generally takes the form of a rectangular plate having opposite ends 52, 54 and rounded corners 56. One end 52 of the bridge 16 is provided with an aperture 62. The other end 54 of the bridge 16 is provided with another aperture 64.

Although the bridge 16 has been described as a rectangular plate having rounded corners, it is appreciated that the bridge 16 may be in other shape such as obround.

A semi-spherical boss 66, 68 is provided at each end 52, 54 of the bridge 16. The bosses 66, 68 are adapted to engage with recesses 50, 50 of the hinge segment 12, 14 respectively in a snap-fit configuration.

Figure 7:
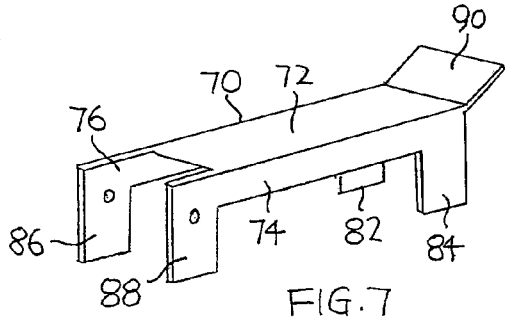
FIG. 7 shows a lock member of the hinge mechanism of FIG. 4.

FIG. 7 shows a lock member 70 of the hinge mechanism 10 in accordance with a preferred embodiment of the invention. The lock member 70 is generally in the form of a clip having an elongated rectangular plate 72 with bent side edges 74, 76. Furthermore, the lock member 70 has two front legs 82, 84 and two rear legs 86, 88 depending downwardly from the two side edges 74, 76 respectively. An integral flap 90 is provided at one end of the plate 72 adjacent to the two front legs 82, 84. The integral flap 90 extends upwardly at an angle with respect to the plate 72. The flap 90 permits a user to flip the lock member 70 from a locked position to an unlocked position.

Figure 8:
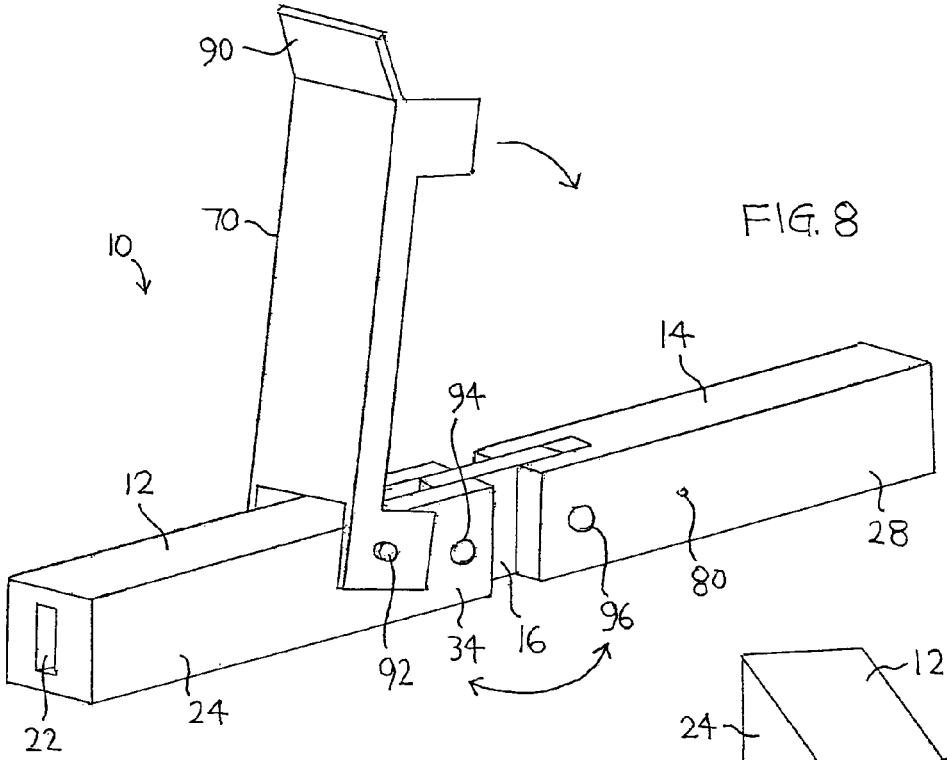
FIG. 8 shows the lock member being coupled to the hinge mechanism of FIG. 4.

FIG. 8 shows the lock member 70 being hingedly connected to the end 34 of the hinge segment 12 by a pin 92. One end 52 of the bridge 16 is interposed in slot 40 of hinge segment 12 in such a position that the apertures 46, 48, 62 are in alignment. A pin or rivet 94 is inserted through the apertures 46, 48, 62 allowing the hinge segment 12 to pivot relative to the bridge 16 about a pivot axis defined by the pin 94.

Similarly, the other one end 54 of the bridge 16 is interposed in slot 40 of hinge segment 14 in such a position that the apertures 46, 48, 64 are in alignment. A pin or rivet 96 is inserted through the apertures 46, 48, 64 allowing the hinge segment 14 to pivot relative to the bridge 16 about a pivot axis defined by the pin 96.

When the hinge mechanism 10 is in the expanded position, as shown in FIG. 8, the bosses 66, 68 on bridge 16 are frictionally engaged with recesses 50, 50 on hinge segments 12, 14 respectively. This frictionally retains the hinge segments 12, 14 in the expanded position.

As shown in FIG. 8, the lock member 70 is in an unlocked position.

Figure 9:
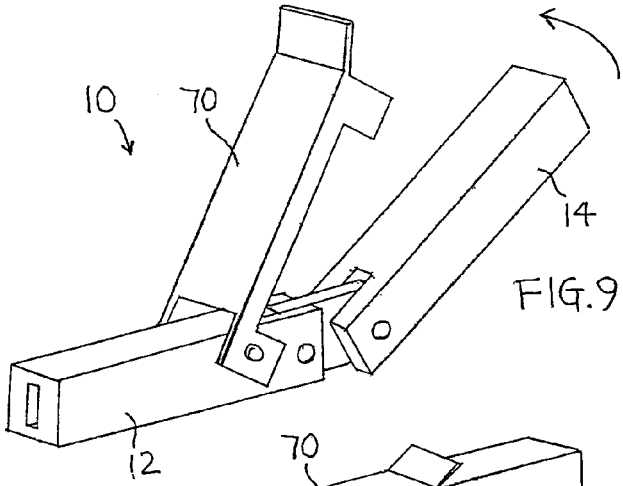
FIG. 9 shows the two segments of the hinge mechanism of FIG. 4 in a partially folding position.

FIG. 9 shows the lock member 70 in an unlocked position and hinge segment 14 moving in a direction, as shown by the arrow, from an expanded position towards a collapsed position. The rounded corners 56 of the bridge 16 and the clearance between the first and second hinge segments 12, 14 permit pivot movement of the first and second hinge segments 12, 14 in both directions.

Figure 10:
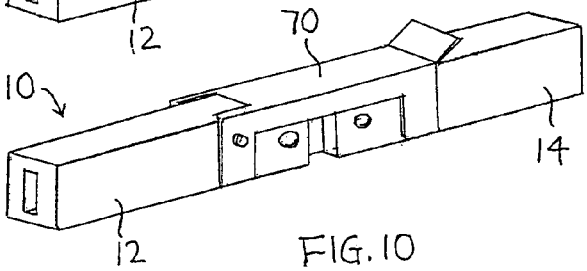
FIG. 10 shows the two segments of the hinge mechanism of FIG. 4 in a fully expanded and locked position.

FIG. 10 shows the hinge segments 12, 14 back in the expanded position and the locked member 70 in the locked position. A projection 80, extending outwardly from at least one side of the hinge segment 14, is adapted to engage with at least one of the front legs 82, 84 and frictionally hold the lock member 70 in the locked position.

The first and second hinge segments 12, 14, the bridge 16, and the lock member 70 may be made of plastic, metal, or any other suitable materials.

Figure 11:
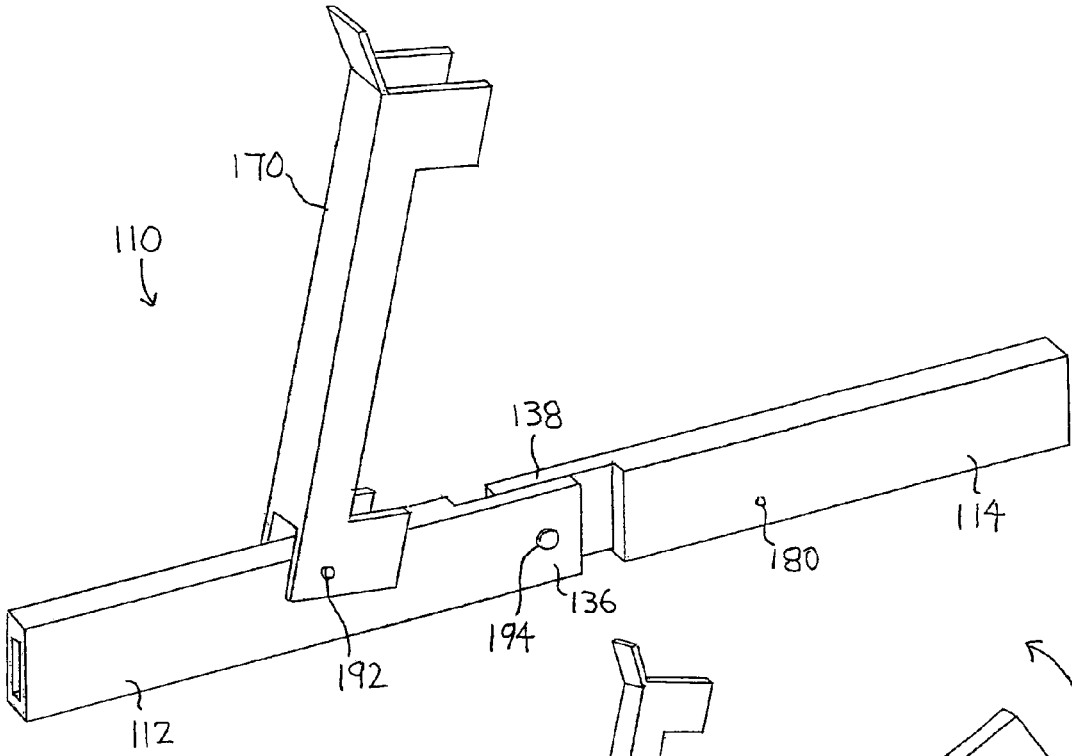
FIG. 11 is a perspective view of a hinge mechanism of a collapsible structure according to a second embodiment of the present invention.

FIG. 11 is a perspective view of a hinge mechanism of a collapsible structure in accordance with a second embodiment of the present invention. The hinge mechanism, generally designated by reference numeral 110, comprises a first hinge segment 112 and a second hinge segment 114. Each of the hinge segments 112, 114 is generally in the form of a planar strip having a height greater than the width.

According to the embodiment of the invention, the first and second hinge segments 112, 114 have longitudinally extending and laterally offset arms 136, 138 respectively which are hingedly connected to each other by a rivet or pin 194. The hinge mechanism 110 is adapted to hingedly connect two frame segments 118, 120 of a collapsible structure of the present invention.

A lock member 170, hingedly connected to hinge segment 112 by a pin 192, is adapted to lock the hinge segments in an expanded position. The lock member 170 is similar to the lock member 70 of the first embodiment except that lock member 170 has a narrower width to fit over the planar hinge segments 112, 114.

Figure 12:
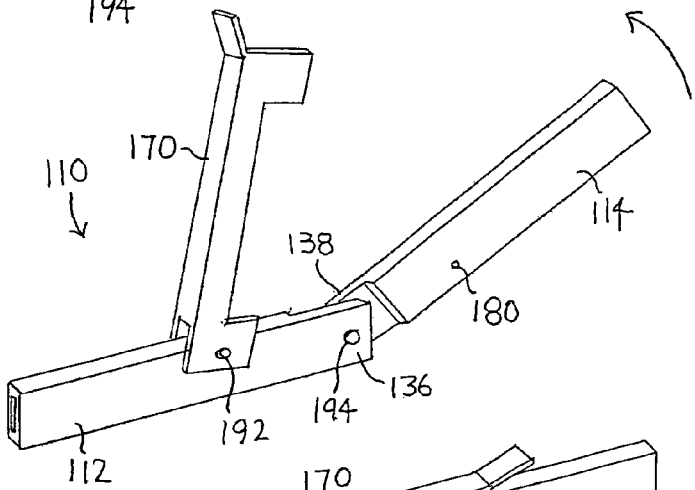
FIG. 12 shows the two segments of the hinge mechanism of FIG. 11 in a partially folding position.

FIG. 12 shows the lock member 170 in an unlocked position and hinge segment 114 moving in a direction, as shown by the arrow, from an expanded position towards a collapsed position.

Figure 13:
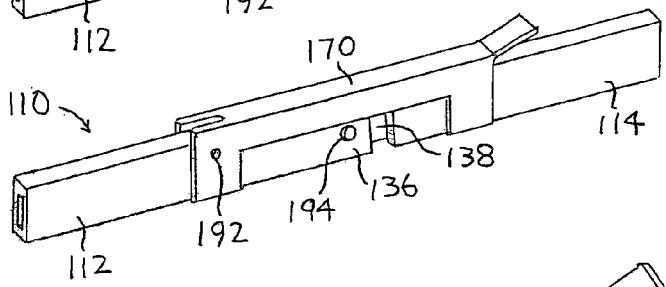
FIG. 13 shows the two segments of the hinge mechanism of FIG. 11 in a fully expanded and locked position.

FIG. 13 shows the hinge segments 112, 114 back in the expanded position and the locked member 170 in the locked position. A projection 180, extending outwardly from one or both sides of the hinge segment 114, is adapted to frictionally hold the lock member 170 in the locked position.

Figure 14:
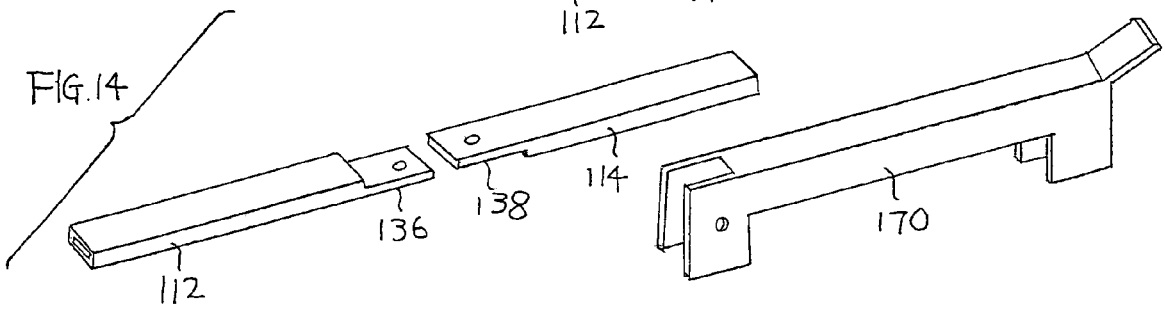
FIG. 14 is an exploded view of the hinge mechanism of FIG. 11.

FIG. 14 is an exploded view of the hinge mechanism 110.

The first and second hinge segments 112, 114, and the lock member 170 may be made of plastic, metal, or any other suitable materials.

Figure 15:
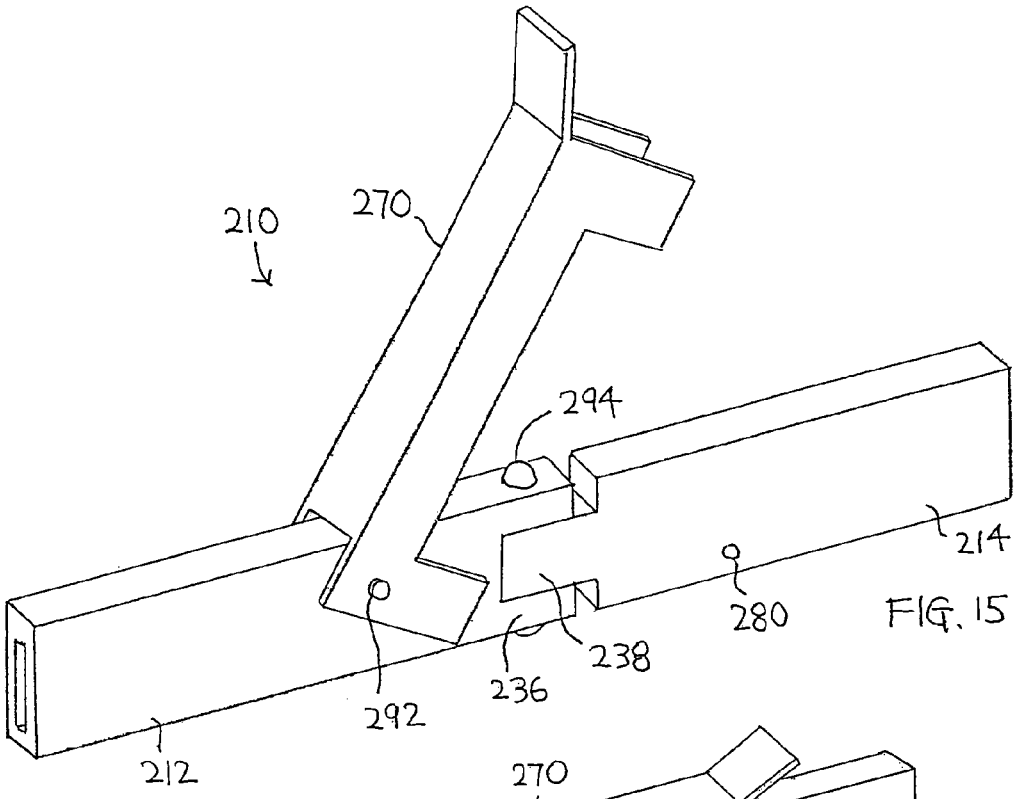
FIG. 15 is a perspective view of a hinge mechanism of a collapsible structure according to a third embodiment of the present invention.

FIG. 15 is a perspective view of a hinge mechanism of a collapsible structure in accordance with a third embodiment of the present invention. The hinge mechanism, generally designated by reference numeral 210, comprises a first hinge segment 212 and a second hinge segment 214. Each of the hinge segments 212, 214 is generally in the form of a planar strip similar to hinge segments 112, 114 of the second embodiment.

According to the embodiment of the invention, the first and second hinge segments 212, 214 have connecting end portions 236, 238 respectively which are hingedly connected to each other by a rivet or pin 294. According to the present embodiment, the end portion 236 is in the form of a slot 240 defined by two longitudinally extending arms 242, 244 whereas the end portion 238 is in the form of a tongue 278. The hinge mechanism 210 is adapted to hingedly connect two frame segments 218, 220 of a collapsible structure of the present invention.

A lock member 270, hingedly connected to hinge segment 212 by a pin 292, is adapted to lock the hinge segments in an expanded position. The lock member 270 is similar to the lock member 170 of the second embodiment. The lock member 270 is in an unlocked position, as depicted in FIG. 12.

Figure 16:
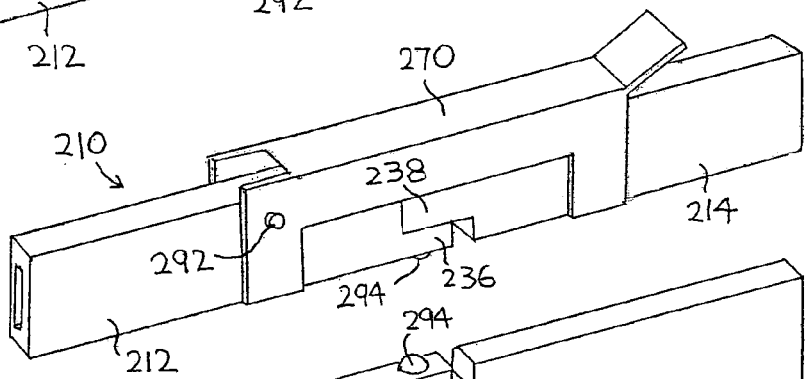
FIG. 16 shows the two segments of the hinge mechanism of FIG. 15 in a fully expanded and locked position.

FIG. 16 shows the lock member 270 in a locked position, and hinge segments 212, 214 in an expanded position. A projection 280, extending outwardly from one or both sides of the hinge segment 214, is adapted to frictionally hold the lock member 270 in the locked position.

Figure 17:
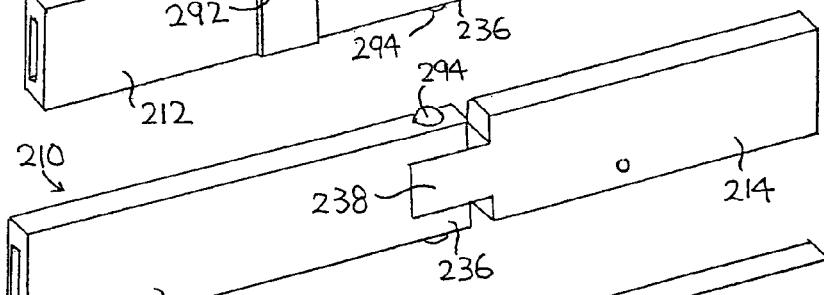
FIG. 17 shows the two segments of the hinge mechanism of FIG. 15 without a lock member.

FIG. 17 shows the hinge mechanism 210 without the lock member 270.

Figure 18:
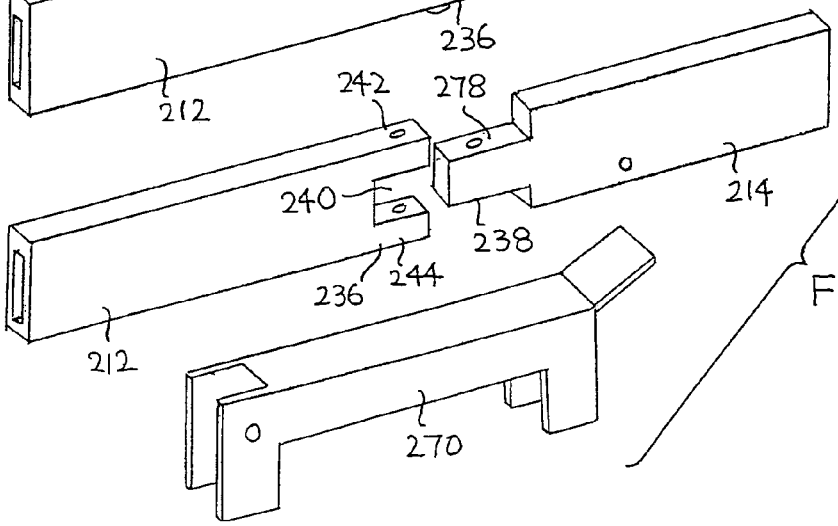
FIG. 18 shows an exploded view of the hinge mechanism of FIG. 15.

FIG. 18 is an exploded view of the hinge mechanism 210.

Similarly, the first and second hinge segments 212, 214, and the lock member 270 may be made of plastic, metal, or any other suitable materials.

While the present invention has been shown and described with particular references to a number of preferred embodiments thereof, it should be noted that numerous other changes or modifications may be made without undue experimentation and without departing from the scope of the present invention. For example, the shapes of the frames are only used for illustration, and it is clear that many other shapes and variations may be made based on the teaching provided herein. The supporting frames may be flat rods, cylindrical rods, or structures of any shape. The joints are illustrated in the drawings using rectangular shapes, but may also be other shapes without departing from the spirit of the invention. The frames may be complete loops, or merely rods or partially open structures. One or more parts of the frame, the whole section or part of a section of the frame may also assume non-linear shapes such, but not limited to, elliptical, hyperbolic, parabollic or sinusoidal shapes, instead of having rectilinear sides.

We claim:

1. A collapsible structure movable between an expanded position to a collapsed position, the collapsible structure comprising:

at least two side portions, each side portion including an upper side portion and a lower side portion, each upper side portion including upper side members pivotally connected to each other via a first hinge, each lower side portion including lower side members pivotally connected to each other via a second hinge, the lower side members being pivotally connected to the upper side members via third hinges;

at least two upper connecting portions, each upper connecting portion including tipper connecting members pivotally connected to each other via a fourth hinge, the upper connecting portions being pivotally connected to the upper side portions via fifth hinges;

at least two lower connecting portions, each lower connecting portion including lower connecting members pivotally connected to each other via a sixth hinge, the lower connecting portions being pivotally connected to the lower side portions via seventh hinges;

wherein the side portions, the upper connection portions, and the lower connection portions define a three dimensional enclosure within the structure in the expanded position; and wherein a first folding axis is defined which passes through the third hinges, and a second folding axis is defined which passes through the first and second hinges.

2. The collapsible structure according to claim 1, wherein the first, second, third, fourth and sixth hinges are constructed and arranged to permit a maximum pivoting movement of 180°.

3. The collapsible structure according to claim 1, wherein the fifth and seventh hinges are constructed and arranged to permit a maximum pivoting movement of 90°.

4. The collapsible structure according to claim 1, wherein the structure comprises two said first hinges, two said second hinges, four said third hinges, two said fourth hinges, four said fifth hinges, two said sixth hinges, and four said seventh hinges.

5. The collapsible structure according to claim 4, wherein in the collapsed position, the first and second hinges are proximal to each other, the third hinges are proximal to each other, the fourth hinges are proximal to each other, and the sixth hinges are proximal to each other.

6. The collapsible structure according to claim 1, wherein the first folding axis is substantially perpendicular to the second folding axis.

7. The collapsible structure according to claim 1, wherein the upper side members are arcuate.

8. The collapsible structure according to claim 1, wherein the lower side members are substantially L-shaped.

9. The collapsible structure according to claim 1, further comprising a fabric material covering a substantial portion of the structure.

10. The collapsible structure according to claim 1, wherein the connecting members are foldable in a direction parallel to the first folding axis, and the fourth and sixth hinges are movable in an inwardly direction.

11. The collapsible structure according to claim 1, wherein the hinges are selected from the group consisting of:

two opposing arms pivotally connected to a connecting piece, each arm being connected by a pivot pin passing through a hole in a pivoting end of the arm and a hole in the connecting piece, the pivoting end of the arm defining a guide to prevent the arm from rotating more than 90° relative to the connecting piece; and two opposing lateral arms and a perpendicular arm pivotally connected to three faces of a connecting piece, respectively, each arm being connected by a pivot pin passing through a hole in a pivoting end of the arm and a hole in the connecting piece, the connecting piece having barrier portions to prevent the lateral arms from rotating more than 45° relative to the connecting piece and to prevent the perpendicular arm from rotating more than 90° relative to the connecting piece.

12. A method for collapsing the collapsible structure according to claim 1, the method comprising the steps of:

pivoting the connecting members at the fourth and sixth hinges to fold the connecting members onto each other such that the at least two side portions are positioned adjacent with each other;

folding the side members onto each other about the first folding axis; and folding the side members onto each other about the second folding axis.

* * * * *